US010518558B1

(12) United States Patent
Izawa et al.

(10) Patent No.: US 10,518,558 B1
(45) Date of Patent: Dec. 31, 2019

(54) DRYING DEVICE AND INK-JET PRINTING DEVICE EQUIPPED WITH THE SAME

(71) Applicant: MIYAKOSHI PRINTING MACHINERY CO., LTD., Narashino-shi, Chiba (JP)

(72) Inventors: Hideo Izawa, Narashino (JP); Kouichi Ooyama, Yokote (JP); Kazushige Sato, Yokote (JP); Hidetoshi Kon, Yokote (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 16/190,829

(22) Filed: Nov. 14, 2018

(30) Foreign Application Priority Data

Jul. 25, 2018 (JP) ..... 2018-139837

(51) Int. Cl.

| | |
|---|---|
| ***B41J 11/00*** | (2006.01) |
| ***F26B 25/20*** | (2006.01) |
| ***F26B 21/00*** | (2006.01) |
| ***F26B 9/00*** | (2006.01) |
| ***B41F 23/04*** | (2006.01) |
| *F26B 3/02* | (2006.01) |

(52) U.S. Cl.
CPC ..... *B41J 11/002* (2013.01); *B41F 23/04* (2013.01); *F26B 9/00* (2013.01); *F26B 21/001* (2013.01); *F26B 25/20* (2013.01); *F26B 3/02* (2013.01)

(58) Field of Classification Search
CPC .... B41J 11/002; B41J 11/0085; B41J 15/165; B41J 15/04; B41J 3/60; F26B 25/20; F26B 9/00; F26B 21/001
USPC ..... 347/102
See application file for complete search history.

(56) References Cited

U.S. PATENT DOCUMENTS 5,713,138 A 2/1998 Rudd
6,152,030 A * 11/2000 Fuqua ..... B41F 15/0863 101/115

(Continued)

FOREIGN PATENT DOCUMENTS

EP 3025866 A2 6/2016
JP 2004106346 A 4/2004

(Continued)

OTHER PUBLICATIONS

Search Report of European Patent Office issued in European Application No. 18205401 in the English language dated May 7, 2019 (5 pages).

*Primary Examiner* — Stephen D Meier
*Assistant Examiner* — Alexander D Shenderov
(74) *Attorney, Agent, or Firm* — Flynn Thiel, P.C.

(57) ABSTRACT

A drying device H is provided with: a heating roller part 10 that guides a printed object X and is capable of heating the rear surface of the printed object X; a hot air blowing part 11 for blowing hot air to the printed surface of the printed object X; a chamber 15 in which the heating roller part 10 and the hot air blowing part 11 are housed; a first plate frame 1 and a second plate frame 2 that are installed on two sides of the chamber 15; a supply-use air blower D1 for supplying air to the hot air blowing part 11; an exhaust-use air blower D2 for exhausting air inside the chamber 15; and a stage 5 on which the supply-use air blower D1 and the exhaust-use air blower D2 are mounted.

8 Claims, 16 Drawing Sheets

(56) References Cited

U.S. PATENT DOCUMENTS

| | | | | |
|---|---|---|---|---|
| 6,308,626 | B1 * | 10/2001 | Crystal | B41J 11/001 101/424.1 |
| 8,534,825 | B2 * | 9/2013 | Leighton | B41J 11/002 347/102 |
| 2006/0096121 | A1 * | 5/2006 | Nagashima | B41F 23/0426 34/618 |
| 2014/0267521 | A1 * | 9/2014 | Suzuki | B41J 11/04 347/102 |
| 2017/0165980 | A1 * | 6/2017 | Kanada | B41J 2/01 |
| 2017/0173973 | A1 * | 6/2017 | Tsutsui | B41J 29/377 |

FOREIGN PATENT DOCUMENTS

| | | | |
|---|---|---|---|
| JP | 2012-013378 | A | 1/2012 |
| JP | 2012-116019 | A | 6/2012 |
| JP | 2013-018247 | A | 1/2013 |

* cited by examiner

DRYING DEVICE AND INK-JET PRINTING DEVICE EQUIPPED WITH THE SAME

TECHNICAL FIELD

The present invention relates to a drying device and an ink-jet printing device equipped with the same, and more specifically, concerns a drying device for heating and drying a printed object efficiently and also for easily carrying out maintenance safely, and an ink-jet printing device equipped with the same.

BACKGROUND ART

A printing device for carrying out printing on a printing object to be printed, such as paper, film, cloth or the like, has been known.

Such printing is generally carried out by applying an ink containing a coloring agent and an aqueous solvent onto a printing object to form a printed object. For this reason, the printed object immediately after the printing process is in a wet state containing the aqueous solvent, and the corresponding aqueous solvent needs to be removed from the printed object.

In the printed object immediately after the printing process from which the aqueous solvent needs to be removed as described above, when much time is required for removing the aqueous solvent, bleeding of ink onto the printing object due to insufficient drying of ink, flocculation of ink, mixed color with ink having another color, retransferring to the printing object caused by an ink transferring process from a contact member to the printing surface and the like tend to occur, thereby causing a problem of degradation in image quality. Therefore, as the printing device, such a printing device provided with a drying device so as to dry the printing object immediately after the printing process has been developed.

For example, an ink-jet recording device (for example, see Patent Literature 1), which is an ink-jet recording device capable of continuously recording on the two surfaces of a web, and provided with a plurality of recording heads installed therein, a drying device for drying the web on which recording is made by the recording heads and guide rollers for guiding the web, and another ink-jet recording device (for example, see Patent Literature 2), which is provided with a line head disposed on the recording surface side of a web, guide rollers for guiding the web, a suction mechanism disposed on the non-recording surface side of the web, and a drying device for drying the web on which recording is made by the recording head, have been known.

In this manner, in general, the drying device is provided with a heating roller part for heating a printing object while guiding the printing object.

In recent years, in the drying device, in the case when the printing object is dried by the heating roller part, since the aqueous solvent is evaporated to float, such a drying device that is provided with a chamber so as to cover the heating roller part and prevent the evaporated aqueous solvent from leaking outside has been developed.

However, since the heating roller part has a large size, when it is equipped with the chamber, a problem arises in which maintenance becomes difficult.

In contrast, a drum type drying machine in which a drying chamber is moved has been known. That is, a drum type drying machine has been known (for example, see Patent Literature 3) in which a drying drum, a drying chamber that is disposed so as to be opposed to at least one portion of the outer circumferential surface of the drying drum and a drying machine main body in which the drying drum and the drying chamber are housed are installed, and in the drying machine main body, inner rail parts extending in parallel with its axis line are installed, and outer rail parts that are continuously coupled to the inner rail parts and extend in the extending direction of the inner rail parts are detachably disposed so that the drying chamber is designed so as to move from the inner rail parts toward the outer rail parts side.

In accordance with such a drum type drying device, by moving the drying chamber, maintenance of the drying drum or the like can be more easily carried out.

CITATION LIST

Patent Literature

PTL 1: Japanese Patent Application Laid-Open No. 2012-116019

PTL 2: Japanese Patent Application Laid-Open No. 2013-18247

PTL 3: Japanese Patent Application Laid-Open No. 2012-13378

SUMMARY OF INVENTION

Technical Problem

However, in the case of the ink-jet recording device described in the above-mentioned Patent Literature 1 and the drum type drying machine described in the above-mentioned Patent Literature 2, it cannot be said that the drying efficiency is superior. That is, since the heating roller part is used for heating the rear surface of a printed object which is made in contact with the heating roller part and to which no ink is applied, the resulting problem is that drying on the printing surface side is hardly carried out.

Moreover, in the case of the drum type drying machine described in the above-mentioned Patent Literature 3, since no specific device for blowing air, such as a hot air blowing device, a supply-use air blower, an exhaust-use air blower or the like, is installed, it cannot be said that maintenance is easily carried out safely even if these are provided.

In view of the above-mentioned circumstances, the present invention has been devised, and its object is to provide a drying device for heating and drying a printed object efficiently and also for easily carrying out maintenance safely.

Solution to Problems

As a result of earnest study made by the present inventors, etc. in view of solving the above-mentioned problems, they have found that by installing a heating roller part and a hot air blowing part for use in drying a printed object, and by coupling a chamber to which the hot air blowing part is attached and fixed and a stage part on which a supply-use air blower and an exhaust-use air blower are installed with each other, as well as by allowing these to be slidable between a heating and drying position and a stand-by position, the above-mentioned problems can be solved so that the present invention has been completed.

The present invention relates to a drying device in which (1) while transporting a long-sized printed object to which an ink has been applied by a printing part, the printed object is dried, and the drying device is provided with a heating roller part that guides the printed object and can also heat the rear surface of the printed object; a hot air blowing part for blowing hot air to the printing surface of the printed object, which is installed so as to be opposed to the outer circumferential surface of the heating roller part; a chamber in which the heating roller part and the hot air blowing part are installed; a first plate frame and a second plate frame that are installed on the two sides of the chamber so as to sandwich the chamber; a supply-use air blower for supplying air to the hot air blowing part through an supply opening formed on the chamber; an exhaust-use air blower for exhausting air inside the chamber through an exhaust opening formed on the chamber; and a stage part on which the supply-use air blower and the exhaust-use air blower are installed, wherein the hot air blowing part is attached and fixed to the chamber; on the second plate frame, a cut-out part through which the chamber is allowed to pass is formed; the chamber and the stage part are installed side by side in the width direction of the printed object, and coupled to each other through the cut-out part as an integral unit; and onto the first plate frame and second plate frame, a pair of rail parts that extend in the width direction of the printed object are formed in a manner so as to cross-link the first plate frame and second plate frame and also to pass through the cut-out part so that the chamber and the stage part are made slidable along the rail parts between a heating and drying position where the chamber is located between the first plate part and the second plate part and a stand-by position where the chamber exposes at least one portion of the heating roller part.

The present invention relates to the drying device described in the above-mentioned (1) in which (2) the exhaust-use air blower has a manifold, and a plurality of exhaust openings are formed on the chamber so that air is sent to the manifold from the respective exhaust openings through pipes and air thus collected is sent to an exhaust duct through the manifold.

The present invention relates to the drying device described in the above-mentioned (1) or (2) in which (3) to the chamber, a pair of plates that extend in the width direction of the printed object are attached, and sliding parts that are slidable relative to the rail parts are respectively attached to the plates.

The present invention relates to the drying device described in any one of the above-mentioned (1) to (3) in which (4) auxiliary rail parts that cross-link the first plate frame and the second plate frame and extend in the width direction of the printed object are formed on the first plate frame and the second plate frame and to the chamber, an auxiliary plate that extends in the width direction of the printed object is attached, with an auxiliary sliding part that is slidable relative to the auxiliary rail parts being attached to the auxiliary plate, so that the auxiliary rail parts are installed above the rail parts and made shorter than the rail parts.

The present invention relates to the drying device described in any one of the above-mentioned (1) to (4) in which (5) a covering member for use in covering the supply-use air blower and the exhaust-use air blower is further provided, and the covering member is freely detachably attached to the stage part.

The present invention relates to the drying device described in any one of the above-mentioned (1) to (5) in which (6) to the second plate frame, an exhaust duct is coupled to be fixed through an arm part, and in the case when the chamber and the stage part are placed at the heating and drying position, an introduction opening part of the exhaust duct and an exhaust opening part of the exhaust-use air blower are made in contact with each other to make the insides thereof mutually communicated with each other, while in the case when the chamber and the stage part are not located at the heating and drying position, the introduction opening part and the exhaust opening part are separated from each other.

The present invention relates to an ink-jet printing device that is provided with (7) a printing part which, while transporting a printing object, carries out a printing process on the printing object, and a drying device described in any one of the above-mentioned (1) to (6) which, while transporting a long-sized printed object that was printed by the printing part, dries the printed object, and the printing part is constituted a plurality of ink-jet printing heads.

The present invention relates to the ink-jet printing device described in the above-mentioned (7) in which (8) drying devices are installed side by side on the upstream side and the downstream side.

Advantageous Effects of Invention

In the drying device of the present invention, since the heating roller part heats the rear surface of the printed object and since the hot air blowing part installed so as to be opposed to the outer circumferential surface of the heating roller part blows hot air to the printing surface of the printed object, the printed object can be efficiently dried from both of the surfaces.

Moreover, since the heating roller part and the hot air blowing part are housed in the chamber, evaporated solvent that is floating can be enclosed inside the chamber. Therefore, it becomes possible to prevent the evaporated solvent from floating and re-adhering to the printed object, or from adhering to the drying device.

Furthermore, since the supply-use air blower and the exhaust-use air blower are further installed, air can be supplied to the hot air blowing part and air containing floating solvent can be exhausted from the exhaust opening of the chamber. Thus, the drying efficiency can be improved.

In the drying device of the present invention, the chamber to which the hot air blowing part is attached to be fixed thereon and the stage part on which the supply-use air blower and the exhaust-use air blower are integrally coupled to each other, and these are made slidable between the heating and drying position and the stand-by position so that in the case when the chamber and the stage are located at the heating and drying position, the printed object can be efficiently dried, while in the case when the chamber and the stage are located at the stand-by position, it becomes possible to carry out maintenance safely as well as easily. In other words, even when the hot air blowing part, the supply-use air blower and the exhaust-use air blower, which relate to air blowing, are installed, it also becomes possible to carry out maintenance safely as well as easily.

Moreover, in the case when the chamber and the stage part are located at the stand-by position, even if a jammed state (hereinafter, referred to simply as "jam") occurs due to a feeding failure of the printed object to the drying device, or tearing, bending or the like of the printed object, the repairing process or the like can be easily carried out.

In the drying device of the present invention, the exhaust-use blower is designed to have a manifold and air collected from the plural exhaust openings formed on the chamber is sent to an exhaust duct from the manifold; therefore, since the exhaust-use pipes that are put outside from the drying device can be gathered to one unit, the drying device itself can be made compacter.

Moreover, another advantage is that upon sliding the chamber and the stage part, the pipes do not interfere with the process.

In the drying device of the present invention, by attaching a plate to the chamber, the chamber can be reinforced.

Moreover, by attaching a sliding part by utilizing the plate, the chamber can be made slidable along the rail parts.

In the drying device of the present invention, the auxiliary rail parts are installed in addition to the rail parts so that the chamber and the stage part are allowed to slide not only along the rail parts, but also along the auxiliary rail parts. Thus, the chamber and the stage part can be made to slide smoothly without rattling.

Moreover, the positional recovering precision at the time of repetitive sliding processes can be improved.

At this time, by installing the auxiliary rail parts at an upper position than the rail parts, with the lengths thereof being made shorter than those of the rail parts, it becomes possible to prevent the auxiliary rail parts from interfering with maintenance processes.

In the drying device of the present invention, by covering the supply-use air blower and the exhaust-use air blower with the covering member, it becomes possible to suppress noise and heat from diffusing outside of the drying device.

Moreover, since the covering member is freely detachably attached to the stage part, it can be attached at the time of the heating and drying process or when it is allowed to slide together with the chamber and the stage part, while it can be removed at the time of maintenance.

In the drying device of the present invention, in the case when the chamber and the stage part are located at the heating and drying position, since the introduction opening part of the exhaust duct and the exhaust opening part of the exhaust-use air blower are made in contact with each other, air can be exhausted from the exhaust duct.

On the other hand, in the case when the chamber and the stage part are not located at the heating and drying position, since the introduction opening part and the exhaust opening part are separated from each other, the exhaust duct can be made a different part from the chamber and the stage part. Thus, in a factory, the exhaust duct can be fixed to a predetermined position. Additionally, in the case when the introduction opening part of the exhaust duct and the exhaust opening part of the exhaust-use air blower are connected with a soft hose or the like, a disadvantage is caused in that the soft hose interferes with sliding processes.

In the ink-jet printing device of the present invention, since the above-mentioned drying device is installed, a printed object on which printing processes were carried out by using a plurality of ink-jet printing heads can be efficiently heated and dried, and it becomes possible to carry out the maintenance of the drying device safely as well as easily.

Moreover, by installing the drying devices on the upstream side and the downstream side in parallel with each other, the drying time for the printed object to be transported can be made sufficiently longer. In this case, since the printed object can be dried even at a comparatively low temperature, it also becomes possible to sufficiently suppress curling of the printed object itself due to heat, or wrinkles and cockling from occurring in the printed object.

Additionally, even in the case when the drying devices are installed in parallel with each other, since they are made slidable respectively in the width direction of the printed object independently, they do not interfere with each other at the time of maintenance.

DESCRIPTION OF EMBODIMENTS

Figure 1A:
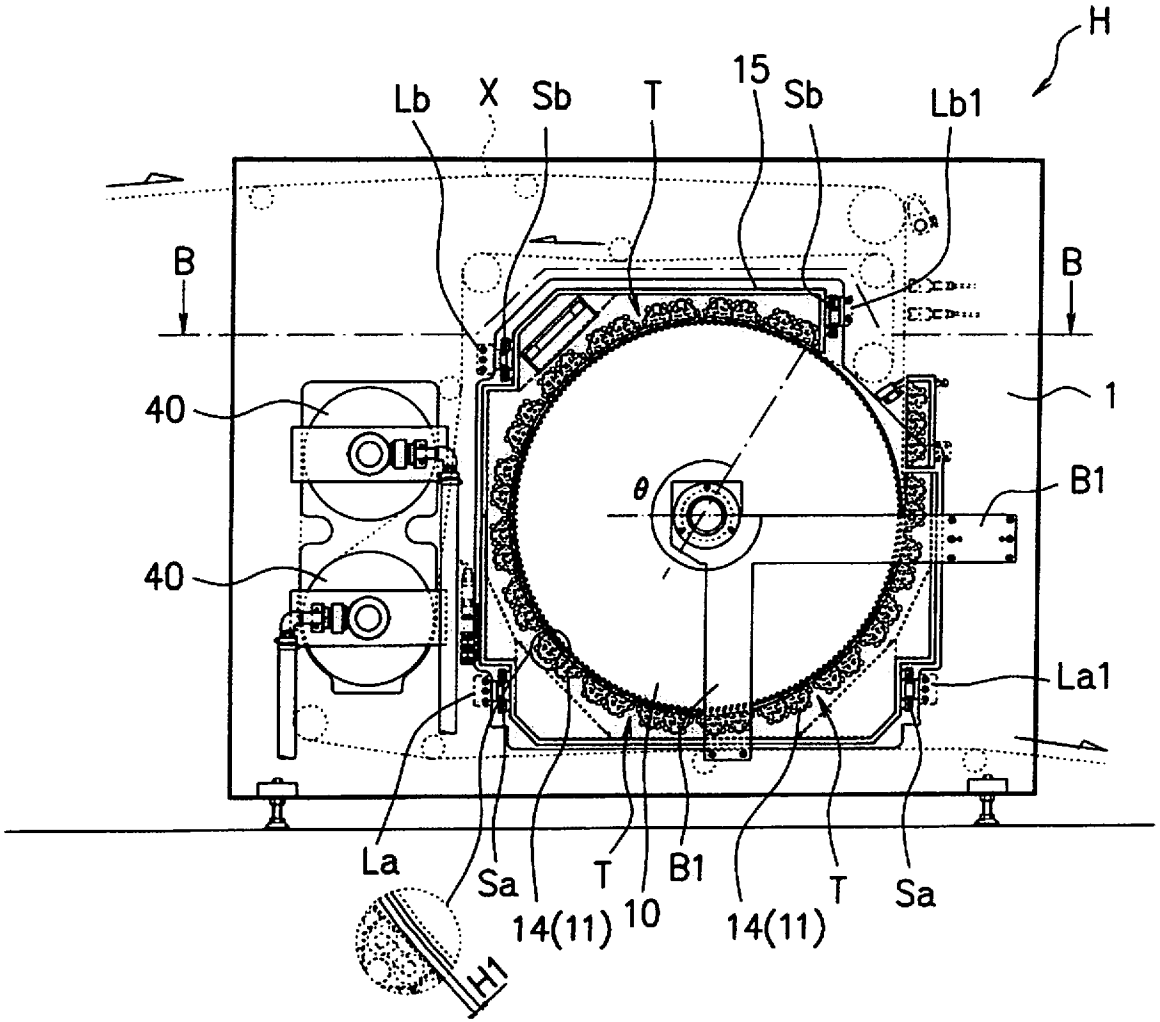
FIG. 1(A) is a perspective side view seen from one side, which schematically shows one embodiment of a drying device in accordance with the present invention.

Referring to Figures on demand, the following description will discuss preferred embodiments of the present invention in detail. Additionally, in the drawings, the same components are indicated by the same reference numerals, and the overlapping descriptions will be omitted. Moreover, the positional relationship, such as upper, lower, left or right side, is based upon the positional relationship shown in the Figure, unless otherwise particularly specified. Furthermore, dimensional ratios of the Figures are not intended to be limited by the dimensional ratios shown in Figures.

First, explanation will be given to a drying device in accordance with the present invention.

The drying device in accordance with the present invention is a device which dries a long-sized printed object corresponding to a printing object onto which an ink has been applied by a printing part, while being transported.

The drying device may be used by being installed in a printing device, or may be continuously used by being installed in parallel with the printing device.

In this case, as the above-mentioned printing object, long-sized paper, film, cloth or the like may be adopted.

As the above-mentioned ink, although not particularly limited, such an ink as to contain a colorant, such as dye, pigment or the like, an aqueous solvent and known additives to be added thereto on demand, may be used.

As the above-mentioned printing device, an ink-jet printing device, an offset printing device, a gravure printing device, a flexographic printing device, a screen printing device and the like may be adopted.

Additionally, in the present specification, "upstream side" means the upstream side in the transporting path of the printed object, and "downstream side" means the downstream side in the transporting path of the printed object. That is, the cooling roller side relative to the heating roller is set to be the downstream side, and the side having no cooling roller is set to be the upstream side.

Moreover, "printing surface" means a surface on the side where the ink for the printing object is applied, and "rear surface" means a surface on the side opposite to the printing surface.

Furthermore, "width direction" means a direction orthogonal to the transporting direction of the printed object.

Figure 1B:
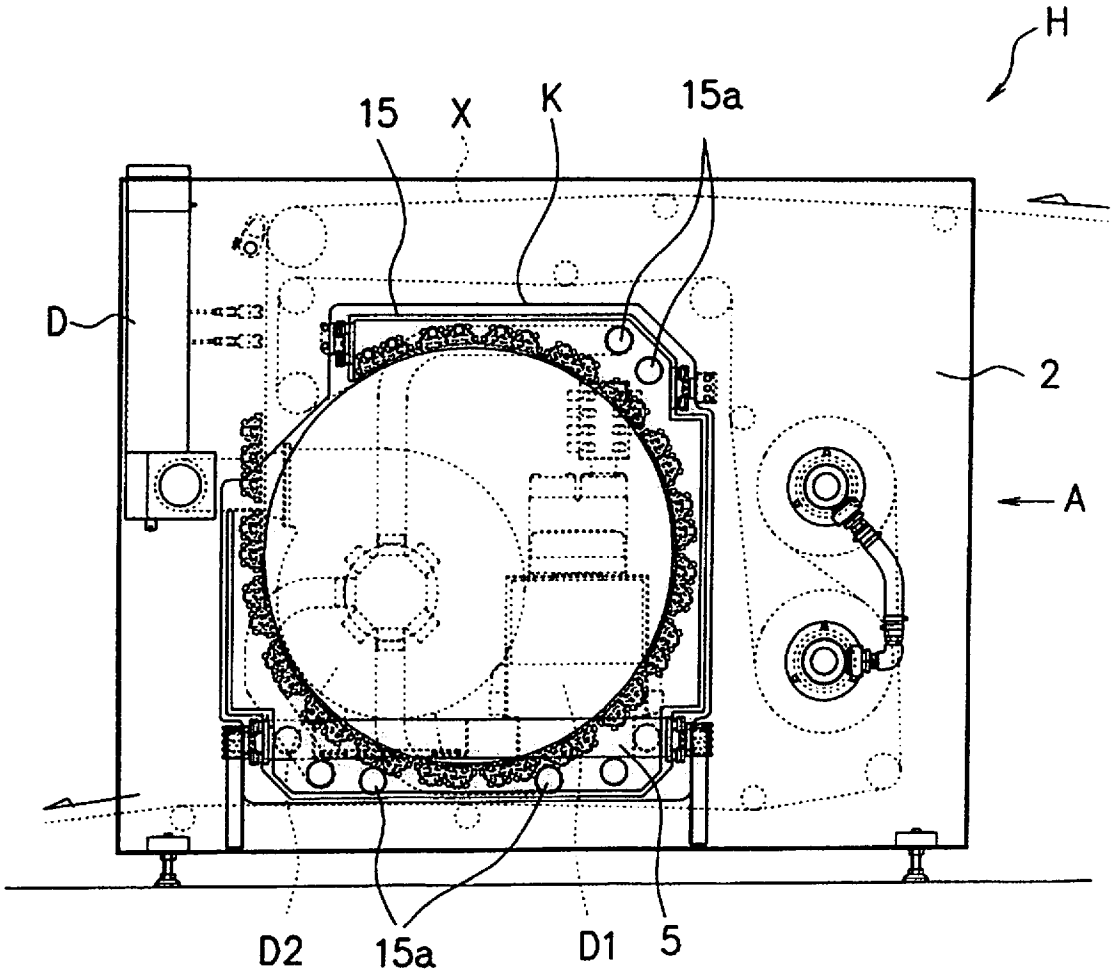
FIG. 1(B) is a perspective side view seen from the other side, which schematically shows the embodiment of a drying device in accordance with the present invention.

FIG. 1(A) is a perspective side view seen from one side, which schematically shows one embodiment of a drying device in accordance with the present invention. FIG. 1(B) is a perspective side view seen from the other side, which schematically shows the embodiment of a drying device in accordance with the present invention. Additionally, FIG. 1(A) is a view obtained by seeing through one portion of each of a first plate frame 1 and a chamber 15, and FIG. 1(B) is a view obtained by seeing through one portion of each of a covering member, a second plate frame 2 and the chamber 15. Moreover, in FIG. 1(A), illustration of an exhaust duct D is omitted, and in FIG. 1(B), illustration of one portion of a pipe to be coupled to an exhaust opening 15*a* is omitted.

As shown in FIG. 1(A), a drying device H relating to the present embodiment is provided with: a heating roller part 10 which, while transporting a printed object X, can heat the printed object X, a hot air blowing part 11 that is installed so as to be opposed to the outer circumferential surface of the heating roller part 10, a chamber 15 in which the heating roller part 10 and the hot air blowing part 11 are housed, a first plate frame 1 (see FIG. 1(B)) and a second plate frame 2 that are formed on the two sides of the chamber 15 so as to sandwich the chamber 15, and a cooling roller 40 that guides the printed object and is also capable of cooling the printed object X.

Moreover, in addition to these, as shown in FIG. 1(B), the drying device H is provided with: a supply-use air blower D1 for supplying air to the hot air blowing part 11 through a supply opening formed on the chamber 15, an exhaust-use air blower D2 for exhausting air inside the chamber 15 through a plurality of exhaust openings 15*a* formed on the chamber 15, an exhaust duct D for discharging air exhausted by the exhaust-use air blower D2, a stage part 5 on which the supply-use air blower D1 and the exhaust-use air blower 2 are mounted and a covering member, not shown, for covering the supply-use air blower D1 and the exhaust-use air blower 2.

Moreover, in the drying device H, the chamber 15 and the stage part 5 are integrally coupled to each other.

In the drying device H, the printed object X to which an ink has been applied by a printing part, not shown, is successively guided by the heating roller part 10 and the cooling roller 40. Additionally the dried printed object X after having been guided by the cooling roller 40, is guided, for example, to a collecting part, not shown, and collected in the collecting part by using a so-called, winding-up system or folding-up system. Alternatively, the printed object X that is dried after having been guided by the cooling roller 40 is guided, for example, to a printing part of another printing device so that the rear surface of the printed object is again printed.

In the drying device H, the printed object X is heated by the heating roller part 10 and the hot air blowing part 11, while being guided by these, and is also cooled by the cooling roller 40.

In this manner, in the drying device H, since the rear surface of the printed object X is dried by being heated when made in contact with the heating roller part 10 and since the printing surface of the printed object X is dried by hot air blown by the hot air blowing part 11, both of the surfaces of the printed object X can be efficiently dried.

Moreover, in the drying device H, since the chamber 15 and the stage part 5 are integrally formed so as to be slidable between a heating and drying position and a stand-by position, as will be described later; therefore, even when the hot air blowing part 11 relating to the blowing process of air, the supply-use air blower D1 and the exhaust-use air blower D2 are installed, maintenance can be easily carried out safely.

First, the printed object X to which the ink has been applied is guided by guide rollers, and further guided by the heating roller part 10 while being wound up on the outer circumferential surface of the heating roller part 10. That is, the heating roller part 10 is allowed to guide the printed object X, and can also heat the rear surface of the printed object X.

At this time, a winding angle θ of the printed object X relative to the heating roller part 10, that is, the angle θ made by a first line that is formed by connecting a point on the side face of the heating roller part 10 at which the printed object X is first made in contact with the heating roller part 10 to the center axis of the heating roller part 10 and a second line that is formed by connecting a point at which the printed object X is last made in contact with the heating roller part 10 to the center axis of the heating roller part 10 is preferably set to 180 degrees or more, and more preferably set to 270 degrees or more. In this case, since the drying time is made sufficiently longer, the printed object can be dried at a comparatively low temperature.

In the drying device H, the heating roller part 10 has a hollow column shape whose outer circumferential surface is designed to be heated. For this reason, the printed object X is heated when made in contact with the outer circumferential surface of the heating roller part 10. Additionally, in order to prevent degradation in image quality of the printing surface due to frictional sliding of the printed object X thereon, the heating roller part 10 is preferably disposed so as to be made in contact with the rear surface of the printed object X.

Figure 2:
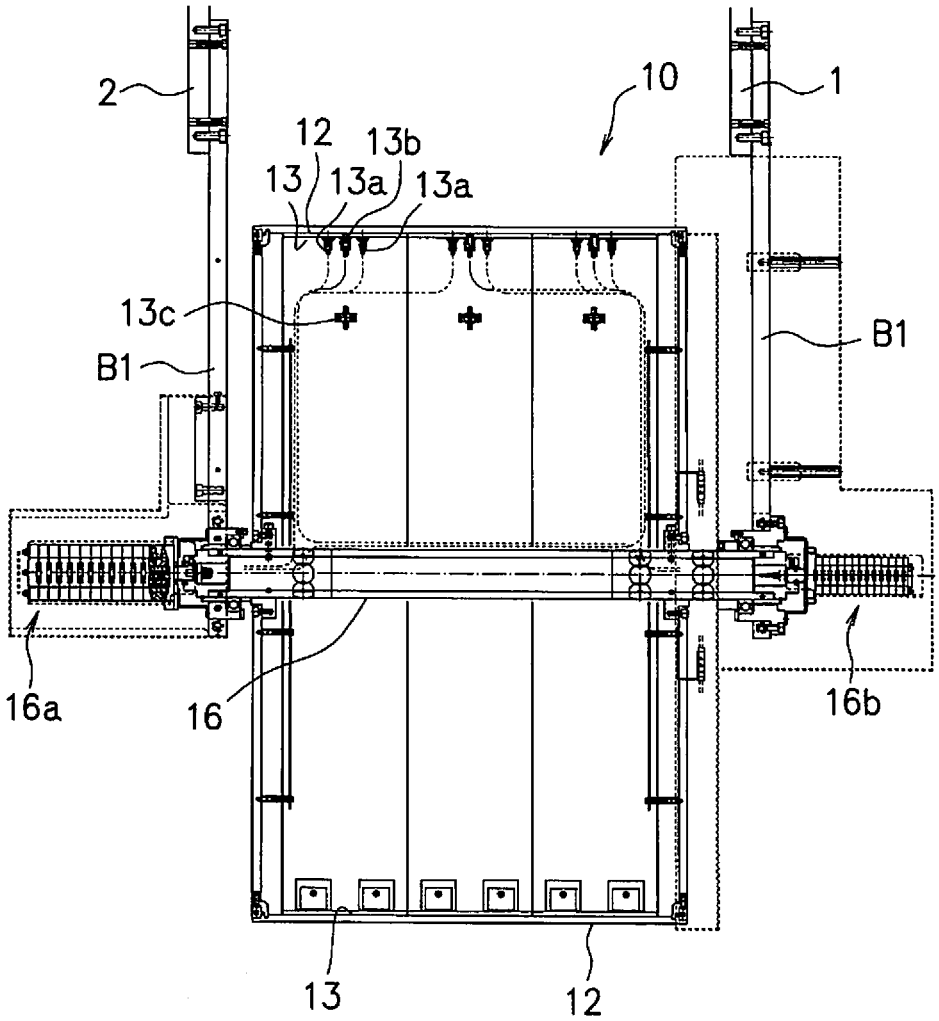
FIG. 2 is a horizontal cross-sectional view showing a heating roller part of the drying device in accordance with the present embodiment.

FIG. 2 is a horizontal cross-sectional view showing the heating roller part of the drying device in accordance with the present embodiment. Additionally, illustration of the chamber 15 is omitted.

As shown in FIG. 2, the heating roller part 10 is provided with a hollow column-shaped drum 12, a band heater 13 for heating the drum 12 and a shaft core 16 to which the two sides of the drum 12 are attached and fixed.

In the heating roller part 10, the drum 12 is made of metal such as aluminum or the like.

Moreover, the drum 12 has its outer circumferential surface subjected to irregularity machining, such as sand blasting, shot blasting, beads blasting or the like. Thus, when the rear surface of the printed object X and the outer circumferential surface of the heating roller part 10 (drum 12) are made in contact with each other, should there be air intruded between these, the air can be released from gaps caused by the surface with irregularities, and by further enhancing the grip, the adhesion onto the drum can also be improved. As a result, it is possible to suppress the drying efficiency of the printed object X from being lowered.

The band heater 13 has an annular shape, and is attached to the inside of the drum 12 in a manner so as to be set along the inner circumferential surface of the drum 12.

Moreover, three sets of the band heaters 13 are placed side by side relative to the width direction of the drum 12.

In each of the band heaters 13, a power source terminal 13*a*, a thermocouple 13*b* for measuring the temperature of the band heater 13 and a thermostat 13*c* for blocking the power supply to the heater upon occurrence of an abnormal heating process are attached to the inner circumferential surface thereof.

Therefore, each band heater 13 has its temperature settable independently and also has its temperature adjustable.

Moreover, for example, in the case when the width of the printed object X is small, the power source for the band heater 13 that is not used can be turned OFF.

In this case, the setting temperature of the heating roller part 10 is adjusted, for example, in a range from 80 to 120° C.

When the setting temperature of the heating roller part 10 is less than 80° C., the printed object is not sufficiently dried in some cases, depending on the material of a printing object to be printed, in comparison with a case in which the setting temperature is located within the above-mentioned range, while in the case when the setting temperature of the heating roller part 10 exceeds 120° C., the printed object might be damaged due to heat depending on the material of a printing object to be printed, in comparison with a case in which the setting temperature is located within the above-mentioned range.

The shaft core 16 has its two sides supported by brackets B1 through bearings, and the bracket B1 on one side is attached to a first plate frame 1 of the drying device H through a frame, and the bracket B1 on the other side is attached to a second plate frame 2 of the drying device H through a frame. For this reason, the heating roller part 10 is made to be freely rotatable relative to the bracket B1. Additionally, the heating roller part 10 is rotated by a frictional force caused by the transportation of the printed object X to be consequently rotated together with the printed object X.

Moreover, to one end of the shaft core 16, a power source-use rotary connector 16*a* is attached, and to the other end thereof, a signal-use rotary connector 16*b* is attached.

Furthermore, each of the aforementioned power source terminals 13*a* is connected to the power source-use rotary connector 16*a* through a cable, and each of the aforementioned thermocouples 13*b* is connected to the signal-use rotary connector 16*b* through a cable.

Returning again to FIG. 1(A), in the drying device H, the hot air blowing part 11 is installed so as to be opposed to the outer circumferential surface of the heating roller part 10, with the printed object X interposed therebetween. That is, the hot air blowing part 11 is installed with a fixed interval from the printing surface of the printed object X.

Therefore, the rear surface of the printed object X is heated by the heating roller part 10, while the printing surface thereof is heated by the hot air blowing part 11.

The hot air blowing part 11 is constituted by a plurality of hot air blowing devices 14 that are aligned side by side along the circumferential direction of the heating roller part 10.

Each of the plural hot air blowing devices 14 corresponding to the hot air blowing part 11 is attached and fixed to the chamber 15, and is also coupled to the supply-use air blower D1 disposed on the outside of the chamber 15 through a supply opening formed on the chamber 15 and a pipe, not shown, attached to the supply opening. For this reason, each of the hot air blowing devices 14 is capable of blowing hot air to the printed object X by the air supply from the supply-use air blower D1. Additionally, although a supply opening is also formed on the chamber 15, it is not illustrated because the position of the supply opening is overlapped with the position of the hot air blowing part 11.

At this time, there is a gap between the printing surface of the printed object X and the hot air blowing device 14 so that the hot air blowing device 14 can blow hot air toward the printing surface of the printed object X with the gap interposed therebetween. Thus, hot air can be blown to the printed object X without irregularities. Moreover, the printed object X is suppressed from partially causing a difference in drying speeds and can be dried more uniformly.

In this case, the shortest distance H1 (see FIG. 1(A)) between the outer circumferential surface of the heating roller part 10 and the hot air blowing device 14 is preferably set to 5 mm to 10 mm.

In the case when the shortest distance H1 is set to less than 5 mm, the printed object X might come into contact with the hot air blowing device 14 (bottom plate 14*a*4) in comparison with a case where the shortest distance H1 is set within the above-mentioned range, and in the case when the shortest distance H1 exceeds 10 mm, the drying efficiency by the hot air blowing device 14 tends to be abruptly lowered in comparison with the case where the shortest distance H1 is set within the above-mentioned range.

Figure 3A:
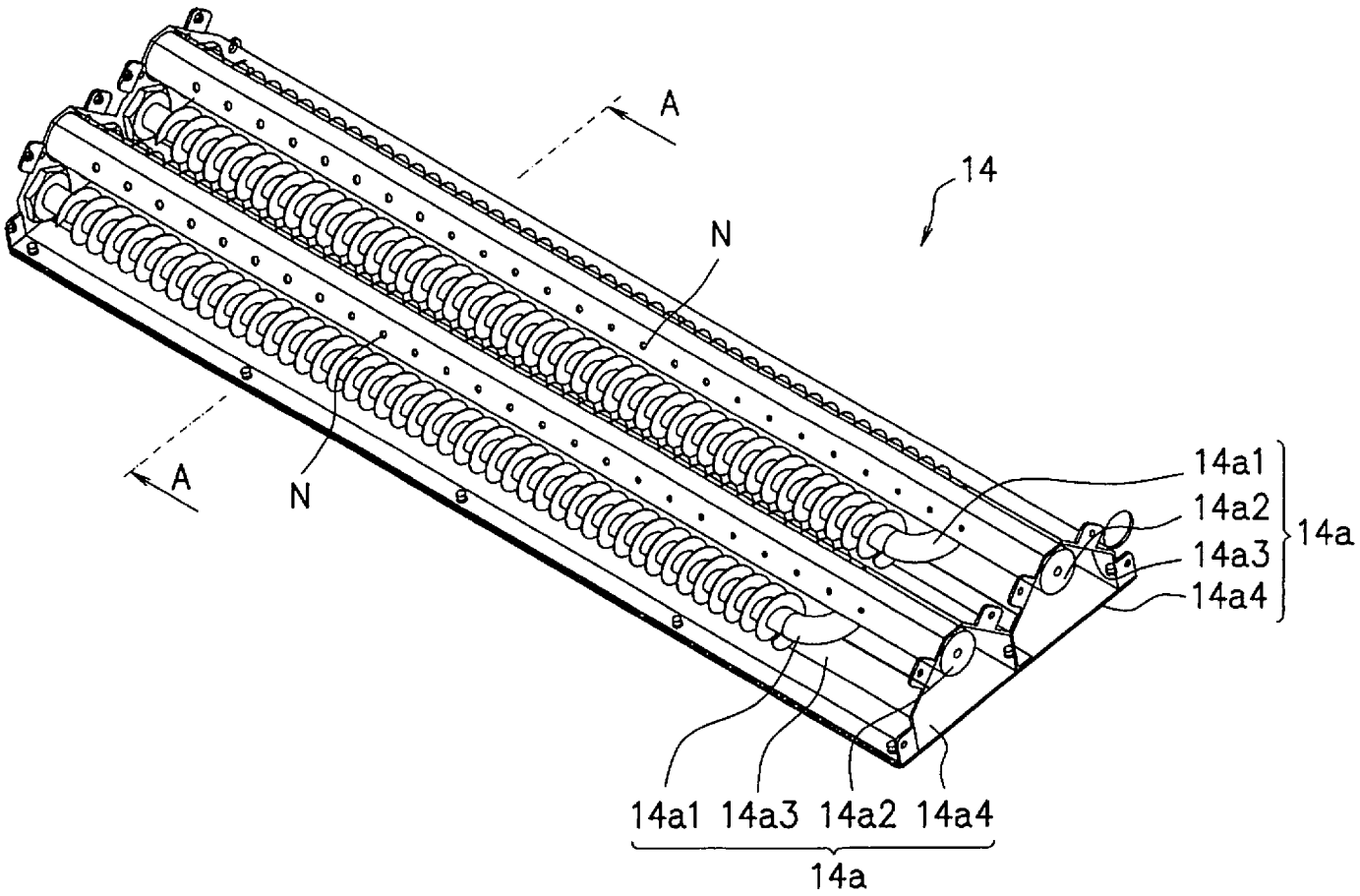
FIG. 3(A) is a perspective view showing a hot air blowing device of the drying device in accordance with the present embodiment.
Figure 3B:
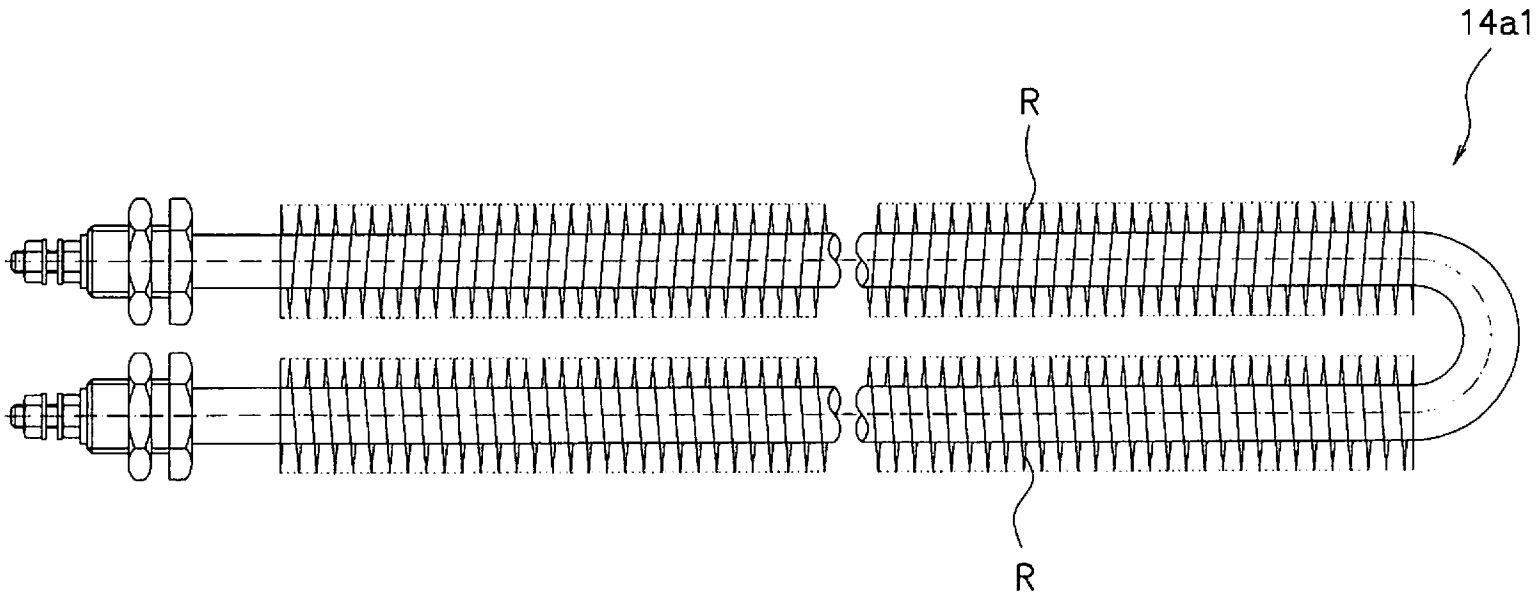
FIG. 3(B) is a top view showing a sheath heater of the hot air blowing device shown in FIG. 3(A).
Figure 3C:
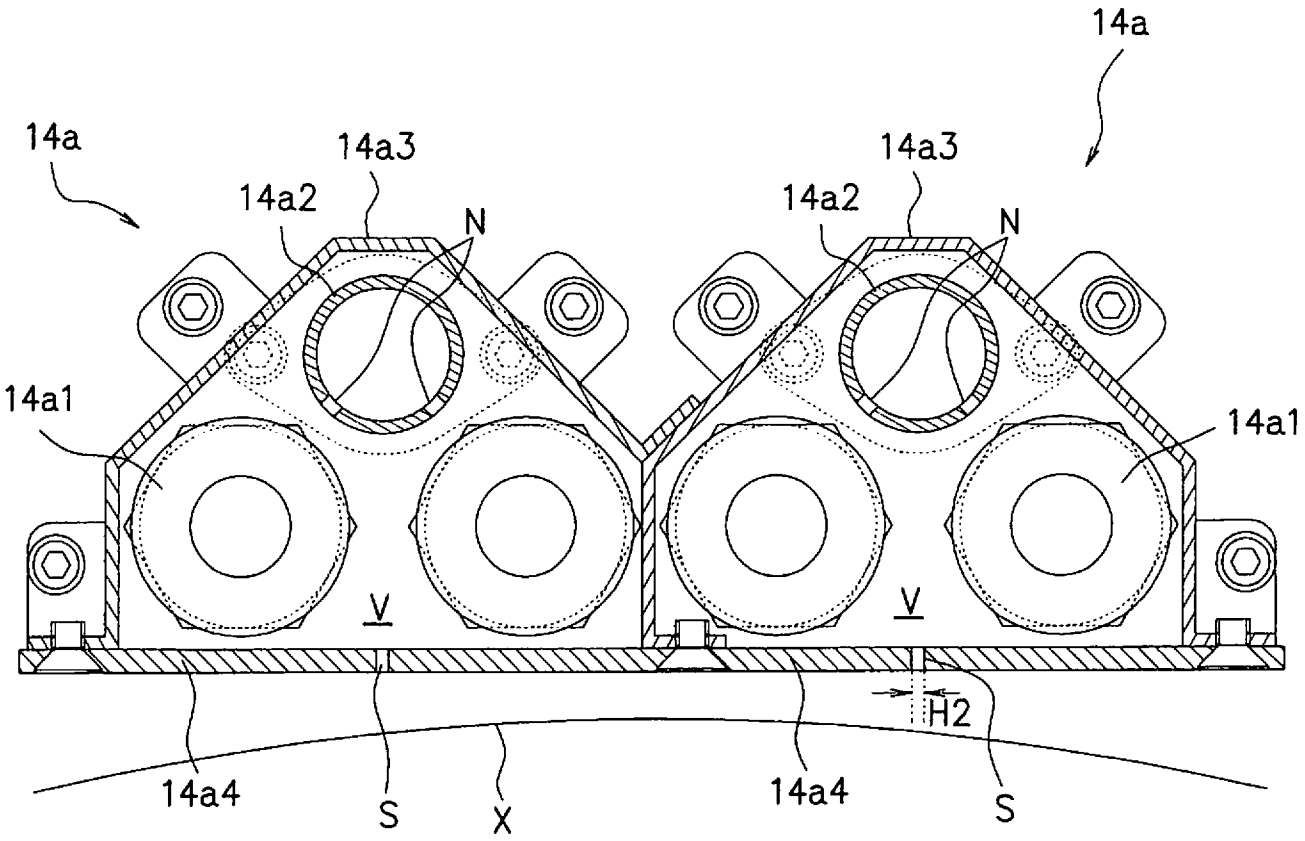
FIG. 3(C) is a cross-sectional view taken along line A-A of the hot air blowing device shown in FIG. 3(A).
Figure 3D:
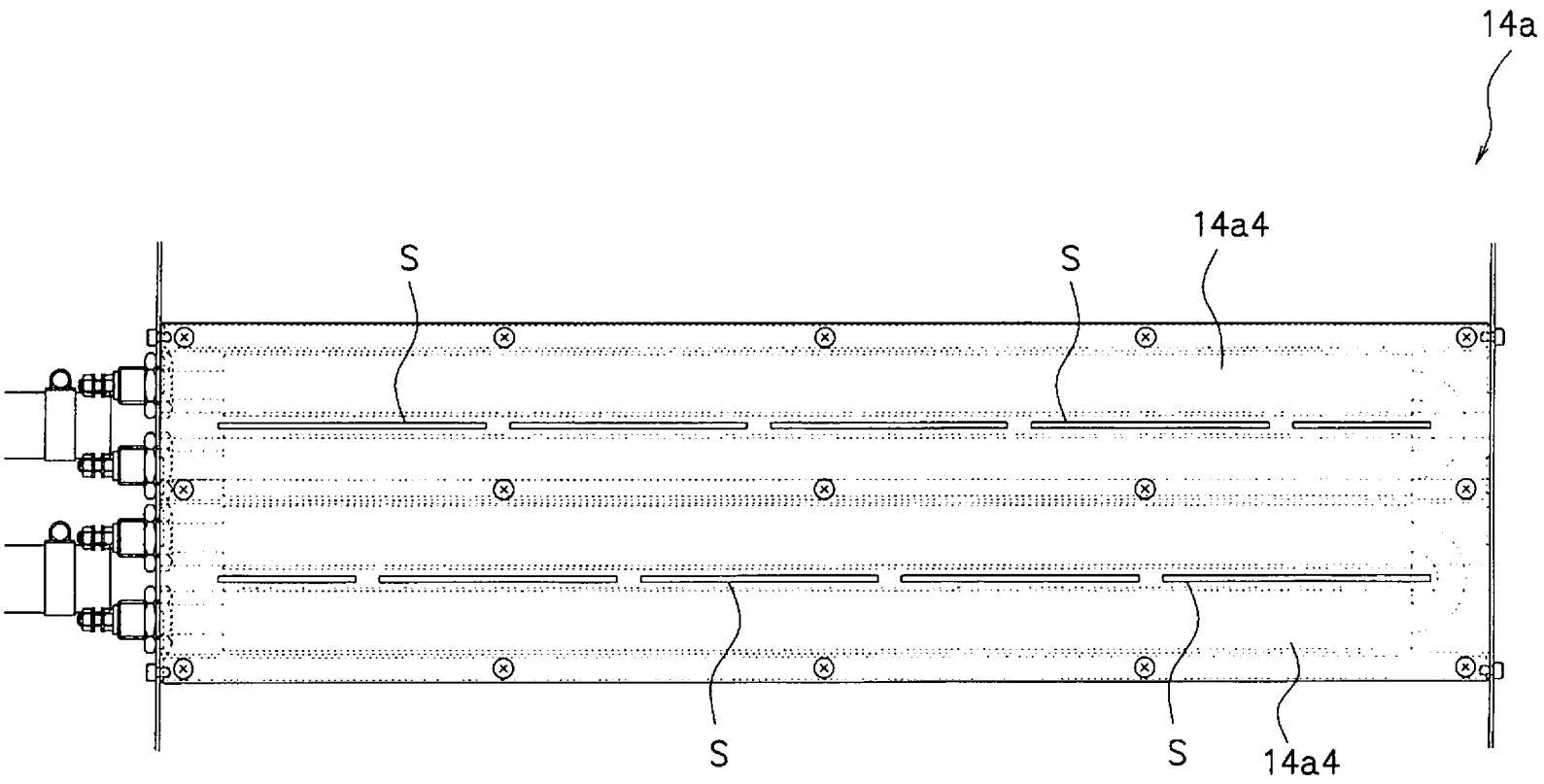
FIG. 3(D) is a bottom view showing the hot air blowing device shown in FIG. 3(A).

FIG. 3(A) is an oblique perspective view showing the hot air blowing device of the drying device in accordance with the present embodiment; FIG. 3(B) is a top view showing a sheath heater of the hot air blowing device shown in FIG. 3(A); FIG. 3(C) is a cross-sectional view taken along line A-A of the hot air blowing device shown in FIG. 3(A); and FIG. 3(D) is a bottom view of the hot air blowing device shown in FIG. 3(A).

As shown in FIG. 3(A), the hot air blowing device 14 is constituted by two blowing units 14*a*.

Moreover, each of the blowing units 14*a* has a hollow rectangular pillar shape that extends in a width direction of the heating roller part 10 so as to be substantially made coincident with the width of the heating roller part 10. For this reason, hot air to be blown from the hot air blowing device 14 covers the entire width of the heating roller part 10.

The blowing unit 14*a* is constituted by a bottom plate 14*a*4, a sheath heater 14*a*1 that is disposed on the bottom plate 14*a*4 so as to form a heating source, a nozzle pipe 14*a*2 capable of blowing air toward the sheath heater 14*a*1, and a heater cover 14*a*3 installed so as to cover the sheath heater 14*a*1 and the nozzle pipe 14*a*2.

As shown in FIG. 3(B), the sheath heater 14*a*1 is bent into a U-letter shape when seen from a top view and electrodes are formed on the ends of the two sides.

Since the sheath heater 14*a*1 has a spiral shaped rib part R, its surface area becomes larger. Thus, on the periphery of the sheath heater 14*a*1, air can be heated with a comparatively large area.

As shown in FIG. 3(C), the sheath heater 14*a*1 is the U-letter shape as described earlier; therefore, when cut along line A-A of FIG. 3(A), the heaters are installed one row by one row on the upstream side and the downstream side.

Moreover, the nozzle pipe 14*a*2 is formed on an upper side between the sheath heaters 14*a*1 on the two sides.

Furthermore, the nozzle pipe 14*a*2 is designed such that compressed air is allowed to flow through the inside thereof, and on the lower side of the nozzle pipe 14*a*2, there are a pair of nozzle holes N formed toward the sheath heaters 14*a*1 on the two sides. In this case, a plurality of the nozzle holes N are formed along the length direction of the nozzle pipe 14*a*2 (see FIG. 3(A)). Therefore, air blown from the nozzle holes N is heated by the sheath heaters 14*a*1.

At this time, the diameter of the nozzle hole N is gradually made smaller as it is departed from the flow inlet of air of the nozzle pipe 14*a*2. That is, the air pressure of incoming air becomes greater at the recessed portion that is the most departed from the flow inlet of air of the nozzle pipe 14*a*2, while the air pressure of incoming air becomes smaller at a portion close to the flow inlet of air of the nozzle pipe 14*a*2; therefore, by making the diameter of the nozzle hole N smaller as it comes closer the recessed portion, the blowing amount of air from each of the nozzle holes N can be made uniform.

In the blowing unit 14*a*, the sheath heater 14*a*1 and the nozzle pipe 14*a*2 are housed in a space V formed by a bottom plate 14*a*4 and the heater cover 14*a*3 coupled to the bottom plate 14*a*4. Therefore, the space V is filled with air heated by the sheath heater 14*a*1.

Moreover, a slit S is formed on the bottom plate 14*a*4 so that the heated air, that is, hot air, is blown onto the printed object X from the slit S.

Additionally, the width H2 of the slit S is preferably set to 0.5 mm to 1 mm from the viewpoints of the amount of blowing air and blowing air speed.

As shown in FIG. 3(D), in the blowing unit 14*a*, a plurality of the slits S are formed so as to extend along the length direction (width direction of the heating roller part 10) of the bottom plate 14*a*4. Thus, hot air can be blown to the entire width of the heating roller part 10.

Returning again to FIG. 1(A), in the hot air blowing part 11, a gap T is formed between the mutual adjacent hot air blowing devices 14. Thus, the hot air blown to the printed object X from the slit S of the hot air blowing device 14 and evaporated aqueous solvent can be released outside through the gap T. As a result, since a convection current of the hot air blown thereto is generated, it is possible to prevent the hot air containing the aqueous solvent from being stagnated on the periphery of the printed object X.

Additionally, as the hot air blowing device 14, such a device similar to the aforementioned thermostat or thermocouple may be installed.

Moreover, the setting temperature of the hot air blowing device 14 is preferably set to the setting temperature or more of the heating roller part 10, and specifically, more preferably set to a temperature obtained by adding 0 to 20° C. to the setting temperature of the heating roller part 10.

In the drying device H, the heating roller part 10 and the hot air blowing part 11 are housed in the chamber 15.

The chamber 15 has a box shape having holes corresponding to the drum 12 on the front face (surface side of the paper of FIG. 1) and the rear face (back side of the paper of FIG. 1), and is formed so as not to interfere with the heating roller part 10 and the hot air blowing part 11, and also so as to cover these. Additionally, at the time of sliding of the chamber 15, the hole on the front face is allowed to pass through the drum 12.

Moreover, the chamber 15 has openings at corner portions so as not to interfere with the transporting process of the printed object X.

In the drying device H, even if the aqueous solvent of the printed object X is evaporated by the heating process of the heating roller part 10 and the hot air blowing part 11, the evaporated solvent can be sufficiently enclosed inside the chamber 15.

Moreover, the chamber 15 has its inner side faces covered with a heat insulating material, not shown, having a heat insulating property in itself, such as glass wool or the like. For this reason, the chamber 15 is allowed to exert a so-called heat shielding effect that suppresses heat generated by the heating roller part 10 and the hot air blowing part 11 from transmitting to the outside of the chamber 15.

As shown in FIG. 1(B), the chamber 15 has a plurality of exhaust openings 15*a* formed on its wall face. Moreover, each of the exhaust openings 15*a* is communicated with an exhaust-use air blower D2 disposed on the outside of the chamber 15 through a pipe, not shown, attached to the corresponding exhaust opening 15*a*.

Therefore, by operating the exhaust-use air blower D2, air inside the chamber 15 can be exhausted from an exhaust duct D on the outside through the exhaust openings 15*a*. Thus, in the chamber 15, even if the aqueous solvent is evaporated and floating, the aqueous solvent can be removed so that it becomes possible to prevent the floating aqueous solvent from re-adhering to the printed object X by dew condensation or from adhering to the inside of the drying device H to cause contamination.

Figure 4:
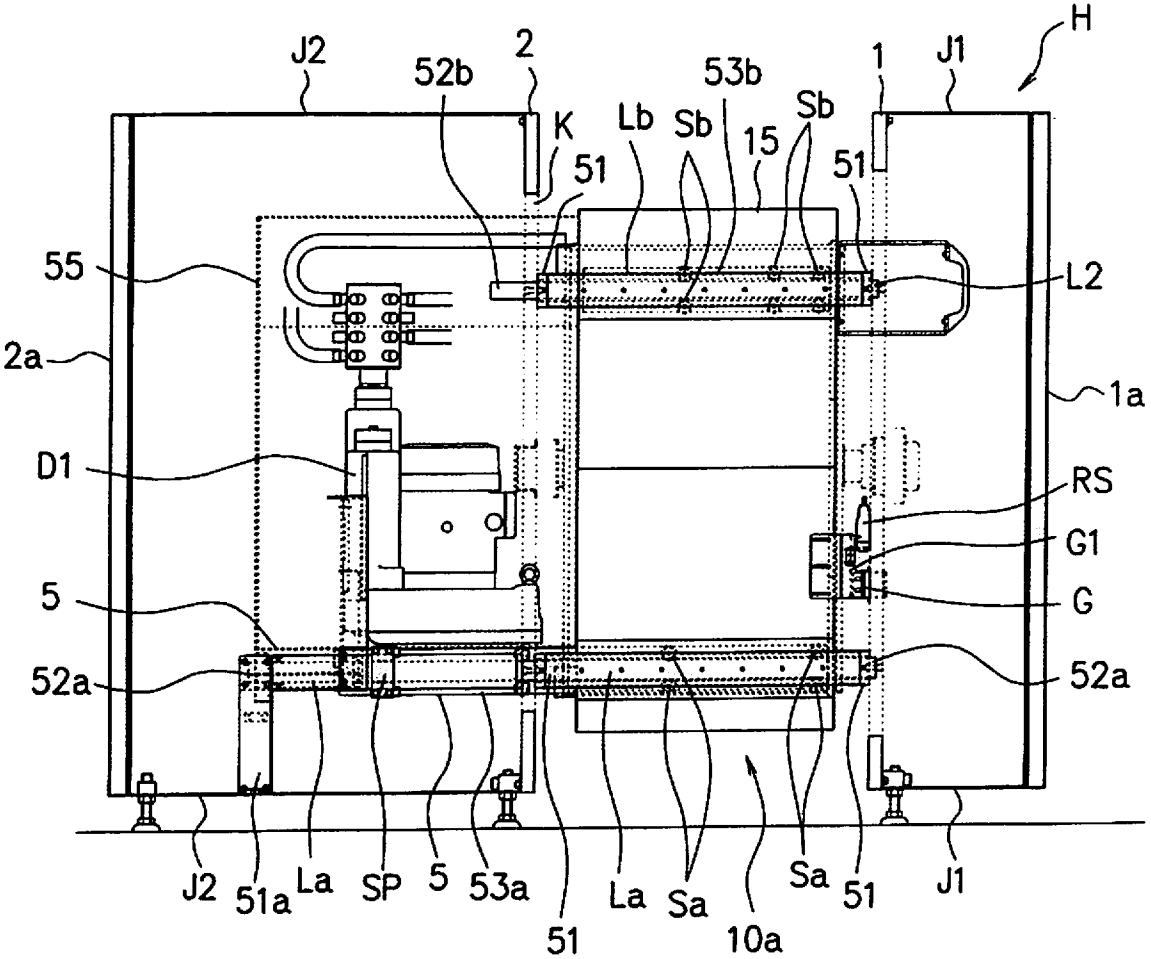
FIG. 4 is a perspective side view seen from an arrow A direction, which shows the drying device of FIG. 1(B).
Figure 5:
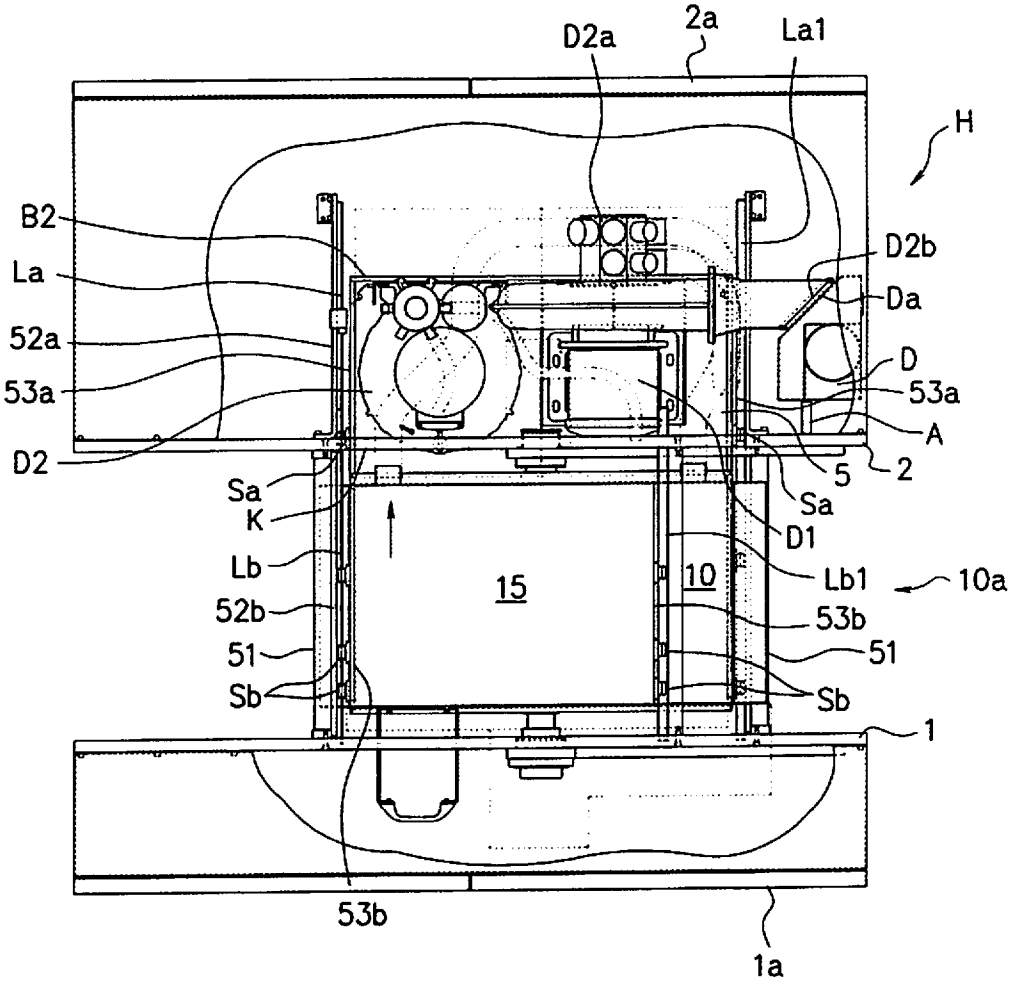
FIG. 5 is a perspective top view cut along line B-B of FIG. 1(A).

FIG. 4 is a perspective side view seen from an arrow A direction showing the drying device of FIG. 1(B), and FIG. 5 is a perspective top view cut along line B-B of FIG. 1(A). Additionally, in FIG. 4, illustrations of the cooling roller 40, the exhaust-use air blower D2, the exhaust duct D and the guiding roller are omitted, and in FIG. 5, illustrations of the cooling roller 40 and the guiding roller are omitted.

As shown in FIG. 4 and FIG. 5, in the drying device H, a first plate frame 1 and a second plate frame 2 are installed on the two sides of the chamber 15, that is, on the two sides of the printed object X to be transported, in a manner so as to sandwich the chamber 15.

The first plate frame 1 and the second plate frame 2 have a plate shape, and are disposed in parallel with each other. Moreover, these frames support two sides of the heating roller part 10, the cooling roller part 40 and other plural guiding rollers.

In the drying device H, magnet parts G capable of magnetically adhering to each other are respectively attached to the inner side face of the first plate frame 1 and the outer side face on the first plate frame 1 side of the chamber 15. These are mutually magnetically adhered to each other so that the chamber 15 can be temporarily fixed to a position 10*a* (hereinafter, referred to as "heating and drying position") for use in heating and drying the printed object X between the first plate frame 1 and the second plate frame 2.

Moreover, on the inner side face of the first plate frame 1, a limit switch RS is installed. In the drying device H, only in the case when the limit switch RS detects that the magnet parts G are magnetically adhered to each other and that the chamber 15 is located at the heating and drying position 10*a*, the drying device H can be operated.

In the drying device H, a cut-out part K is formed on the second plate frame 2.

The cut-out part K has such a size that the chamber 15 and the stage part 5 are allowed to pass through the second plate frame 2 (see FIG. 1(A)).

Moreover, on the peripheral edge of the cut-out part K of the second plate frame 2, a rail part for use in sliding the chamber 15 is attached, as will be described later.

In the drying device H, on a side opposite to the chamber 15 of the first plate frame 1, a first door part 1*a* is installed, and the first door part 1*a* and the first plate frame 1 have their mutual upper ends and lower ends coupled to each other with coupling members J1.

In the same manner, on a side opposite to the chamber 15 of the second plate frame 2, a second door part 2*a* is installed, and the second door part 2*a* and the second plate frame 2 have their mutual upper ends and lower ends coupled to each other with coupling members J2.

Since the drying device H has the first door part 1*a* and the second door part 2*a*, it is superior in safety. Moreover, at the time of maintenance or the like, it is allowed to proceed to the inside through the first door part 1*a* and the second door part 2*a*.

The first plate frame 1 and the second plate frame 2 are coupled to each other by a plurality of stays 51 that extend in the width direction of the printed object. That is, each stay 51 has its one end attached and fixed onto the first plate frame 1 and the other end attached and fixed onto the peripheral edge of the cut-out part K of the second plate frame 2, so as to cross-link the first plate frame 1 and the second plate frame 2. Additionally, with respect to the stays 51, two of them are installed on the upper side and the lower side relative to the first plate frame 1 on the upstream side of the chamber 15 and the peripheral edge of the cut-out part K of the second plate frame 2, and two of them are installed on the upper side and the lower side relative to the first plate frame 1 on the downstream side of the chamber 15 and the peripheral edge of the cut-out part K of the second plate frame 2.

In the first plate frame 1 and the second plate frame 2 on the downstream side of the chamber 15, to the stay 51 on the lower side, a rail base 52*a* is attached. Additionally, the rail base 52*a* extends to a position corresponding to the end part on the opposite side (second door part 2*a* side) to the chamber 15 of the stage 5 from the first plate frame 1, and a leg part 51*a* extending in the vertical direction is attached to the end part on the second door part 2*a* side of the rail base 52*a*. In other words, the rail base 52*a* is supported by the first plate frame 1, the second plate frame 2 and the leg part 51*a*.

Moreover, a rail part La is attached to the rail base 52*a*. That is, to the stay 51 on the lower side, the rail part La is attached through the rail base 52*a*.

In the first plate frame 1 and the second plate frame 2 on the downstream side of the chamber 15, to the stay 51 on the upper side, an auxiliary rail base 52*b* is attached. Additionally, the auxiliary rail base 52*b* extends from the first plate frame 1 to the second plate frame 2. In other words, the auxiliary rail base 52*b* is supported by the first plate frame 1 and the second plate frame 2.

Moreover, an auxiliary rail part Lb is attached to the auxiliary rail base 52*b*. That is, to the stay 51 on the upper side, the auxiliary rail part Lb is attached through the auxiliary rail base 52*b*.

For this reason, the rail part La and the auxiliary rail part Lb cross-link the first plate frame 1 and the second plate frame 2 in the same manner as in the stay 51.

In this case, the stay 51 on the upper side and the stay 51 on the lower side, the rail base 52*a* and the auxiliary rail base 52*b*, as well as the rail part La and the auxiliary rail part Lb, are mutually in parallel with each other, and each of these has a structure extending in the width direction (shaft core direction of the heating roller part).

In the drying device H, the auxiliary rail part Lb is made shorter than the rail part La. That is, the rail part La extends from the first plate frame 1 to the end part on the side (second door part 2*a* side) opposite to the chamber 15 of the stage part 5 after passing through the cut-out part K, while the auxiliary rail part Lb extends from the first plate frame 1 to the peripheral edge of the cut-out part K of the second plate frame 2.

In this manner, since the auxiliary rail part Lb is installed on an upper side from the rail part La, with a length shorter than that of the rail part La, the resulting advantage is that the auxiliary rail part Lb is prevented from interfering at the time of maintenance.

In the drying device H, on the first plate frame 1 and the second plate frame 2, the paired rail part La and auxiliary rail part Lb are respectively installed, and the chamber 15 is supported on these through sliding parts to be described later so as to be slidable relative to these.

Moreover, the stage part 5 is supported on the rail part La through the sliding parts to be described later so as to be slidable thereon.

That is, in the first plate frame 1 and the second plate frame 2 on the upstream side of the chamber 15, the rail part La1 and the auxiliary rail part Lb1 are attached to the first plate frame 1 and the peripheral edge of the cut-out part K on the upstream side of the second plate frame 2 at positions corresponding to the rail part La and the auxiliary rail part Lb on the downstream side.

Additionally, since the configurations of the rail base 52*a* and the stay 51 to which the rail part La1 on the upstream side is attached, as well as the auxiliary rail base 52*b* and the stay 51 to which the auxiliary rail part Lb1 on the upstream side are attached, are the same as those on the downstream side, explanations thereof will be omitted.

In the drying device H, in a middle of the rail part La, a stopper SP for stopping the sliding of the chamber 15 and the stage part 5 is installed.

In the drying device H, by making the sliding part Sa in contact with the stopper Sp, the sliding of the chamber 15 and the stage part 5 is stopped at a position 10*b* (hereinafter, referred to as "stand-by" position) where at least one portion of the heating roller part 10 is exposed by the chamber (see FIG. 7(A) and FIG. 7(B)). Additionally, the stand-by position 10*b* can be set on demand by changing the position of the stopper SP.

Moreover, the stopper SP is detachably attached to the rail part La. For this reason, by removing the stopper SP, the chamber 15 and the stage part 5 can be moved by exceeding the stand-by position 10*b*. Additionally, in this case, all the heating roller part 10 can be exposed.

In the drying device H, on the outer side face on the downstream side of each of the chamber 15 and the stage part 5, a plate 53*a* extending in the width direction of the printed object X is attached to a position corresponding to the rail part La.

In the same manner, on the outer side face on the downstream side of the chamber 15, an auxiliary plate 53*b* extending in the width direction of the printed object X is attached to a position corresponding to the auxiliary rail part Lb.

Thus, the chamber 15 can be reinforced.

Moreover, to the plate 53*a*, a plurality of sliding parts Sa, such as bearings or the like, are attached.

In the same manner, to the auxiliary plate 53*b*, a plurality of auxiliary sliding parts Sb, such as bearings or the like, are attached.

Furthermore, the sliding parts Sa are made slidable relative to the rail part La, and the auxiliary sliding parts Sb are made slidable relative to the auxiliary rail part Lb.

In this case, the plate 53*a* and the auxiliary plate 53*b* are mutually in parallel with each other, and each of them has a structure that extends in the width direction of the printed object X (shaft core direction of the heating roller part).

At this time, the auxiliary plate 53*b* is attached to a position above the plate 53*a*, and is made shorter than the plate 53*a*. That is, the plate 53*a* extends over the entire width of the chamber 15 and the stage part 5, while the auxiliary plate 53*b* extends over the entire width of only the chamber 15.

In this manner, since the auxiliary plate 53*b* is installed at the position above the plate 53*a* and is made shorter than the plate 53*a*, the auxiliary plate 53*b* is prevented from interfering at the time of maintenance.

In the drying device H, on the outer side faces of the chamber 15 and the stage part 5, the paired plate 53*a* and auxiliary plate 53*b* are respectively installed.

That is, with respect to the outer side face on the upstream side of the chamber 15, the plate 53*a* is attached to a position corresponding to the rail part La1 on the upstream side, and the auxiliary plate 53*b* is attached to a position corresponding to the auxiliary rail part Lb1 on the upstream side.

Additionally, since the configurations of the plate 53*a* and the auxiliary plate 53*b* on the upstream side are the same as those on the downstream side, explanations thereof are omitted.

Figure 6A:
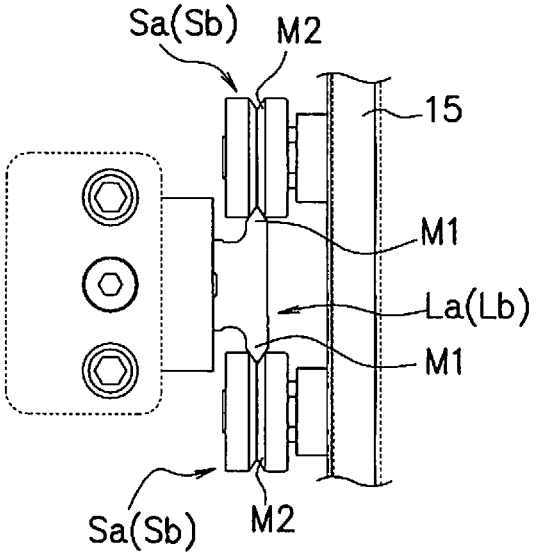
FIG. 6(A) is an enlarged cross-sectional view showing rail parts and sliding parts on the downstream side of a chamber in the drying device in accordance with the present embodiment.
Figure 6B:
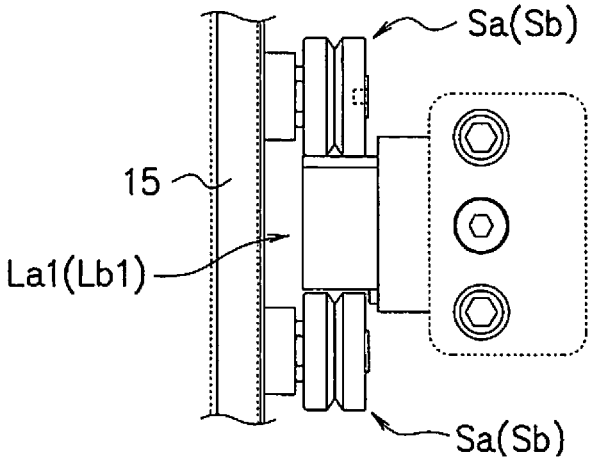
FIG. 6(B) is an enlarged cross-sectional view showing rail parts and sliding parts on the upstream side of the chamber in the drying device in accordance with the present embodiment.

FIG. 6(A) is an enlarged cross-sectional view showing the rail part and the sliding part on the downstream side of the chamber in the drying device in accordance with the present embodiment, and FIG. 6(B) is an enlarged cross-sectional view showing the rail part and the sliding part on the upstream side of the chamber in the drying device in accordance with the present embodiment.

As shown in FIG. 6(A), in the drying device H, the rail part La on the downstream side of the chamber 15 is made of a rectangular member having a convex part M1 that is continuously connected to the upper surface and the lower surface, and the sliding part Sa (for example, a bearing) has a column shape having a concave part M2 in the circumferential direction.

Moreover, the sliding parts Sa are installed on the upper side and lower side of the rail part La so as to sandwich the rail part La.

Furthermore, with the convex part M1 of each of the upper surface and lower surface of the rail part La, the concave part M2 of the sliding part Sa is made in contact, and the sliding part Sa is allowed to pivot in this state so that the chamber 15 is allowed to slide in the width direction, in a position-determined state relative to the transporting direction of the printed object X.

Additionally, with respect to the auxiliary rail part Lb and the auxiliary sliding part Sb on the downstream side of the chamber 15, the same configurations are provided.

On the other hand, as shown in FIG. 6(B), the rail part La1 on the upstream side of the chamber 15 is made of a rectangular member having no convex part.

Moreover, the sliding parts Sa are installed on the upper and lower sides of the rail part La1 so as to sandwich the rail part La1.

Furthermore, each of the sliding parts Sa (for example, bearing) is allowed to pivot so that the chamber 15 and the stage part 5 are allowed to slide in the width direction.

At this time, since the chamber 15 and the stage part 5 are not position-determined relative to the transporting direction of the printed object X, a change or the like in dimension due to a machining error and heat can be absorbed.

Additionally, with respect to the auxiliary rail part Lb1 and the auxiliary sliding part Sb on the upstream side of the chamber 15, the same configurations are provided.

In this manner, in the drying device H, in addition to the rail parts La and La1, the auxiliary rail parts Lb and Lb1 are installed so that the chamber 15 and the stage part 5 are allowed to slide not only along the rail parts La and La1, but also along the auxiliary rail parts Lb and Lb1. For this reason, the chamber 15 and the stage part 5 can be made to slide smoothly without rattling. Moreover, the positional recovering precision at the time of repetitive sliding processes can be improved.

Returning again to FIG. 4 and FIG. 5, it can be seen that in the drying device H, the chamber 15 and the stage part 5 are supported by the rail base 52*a* attached to the first plate frame 1 and the second plate frame 2 through the sliding parts Sa attached to the plates 53*a* on the two sides of these, and are also supported by the auxiliary rail base 52*b* attached to the first plate frame 1 and the second plate frame 2 through the auxiliary sliding parts Sb attached to the auxiliary plates 53*b* on the two sides of the chamber 15.

Moreover, the chamber 15 and the stage part 5 are serially arranged side by side in the width direction of the printed object X through the cut-out part K.

Furthermore, the stage part 5 is coupled to the chamber 15, and designed to protrude on the second door part 2*a* side after passing through the cut-out part K from the chamber 15. That is, the chamber 15 and the stage 5 are integrally formed.

The stage part 5 has a top surface on which the supply-use air blower D1 and the exhaust-use air blower D2 are mounted side by side in the transporting direction of the printed object X.

Moreover, on the stage part 5, a bracket B2 is erected, and onto the bracket B2, the supply-use air blower D1 and the exhaust-use air blower D2 are attached and fixed. Thus, at the time of the sliding process of the stage part 5, it becomes possible to prevent the supply-use air blower D1 and the exhaust-use air blower D2 from being deviated in their positions and from overturning.

In the drying device H, onto the stage part 5, a covering member 55 for use in covering the supply-use air blower D1 and the exhaust-use air blower D2 is attached. Thus, it is possible to suppress noise and heat from diffusing outside of the covering member 55.

The covering member 55 is freely detachably attached to the stage part 5. For this reason, at the time of heating and drying processes, by attaching the covering member 55, the above-mentioned effects can be exerted. Moreover, at the time of sliding the chamber 15 and the stage part 5, by attaching the covering member 55, the sliding processes can be carried out safely. Furthermore, at the time of maintenance, by removing the covering member 55, the maintenance can be carried out easily.

As described above, the supply-use air blower D1 is a device for supplying air to the hot air blowing device 14 from the plural supply openings formed on the wall surface of the chamber 15 through pipes.

As described above, the exhaust-use air blower D2 is a device for exhausting air inside the chamber 15 from the plural exhaust openings 15*a* formed on the wall surface of the chamber 15 through pipes.

In this case, the exhaust-use air blower D2 has a manifold D2*a*. For this reason, air is sent from the plural exhaust openings 15*a* to the manifold D2*a* through the pipes, and the collected air is exhausted from the manifold D2*a*. Thus, in the drying device H, since the exhaust pipes that extend outside from the drying device H can be concentrated into one, it becomes possible to make the drying device H itself compact. Moreover, another advantage is that upon siding the chamber 15 and the stage part 5, the pipes are prevented from intervening with the sliding process.

The air inside the chamber 15 is sent to an exhaust duct D from the manifold D2*a*.

The exhaust duct D is coupled and fixed to the second plate frame 2 through an arm part A. That is, the exhaust duct D is not allowed to slide, and is prepared as a unit independent from the chamber 15 and the stage part 5. For this reason, in a factory, the exhaust duct D can be fixed to a predetermined position. Additionally, in the case when an introduction opening part Da of the exhaust duct D and an exhaust opening part D2*b* of the exhaust-use air blower D2 are connected to each other by using a soft hose or the like, a disadvantage is caused in that the soft hose intervenes with the sliding operations.

Figure 7A:
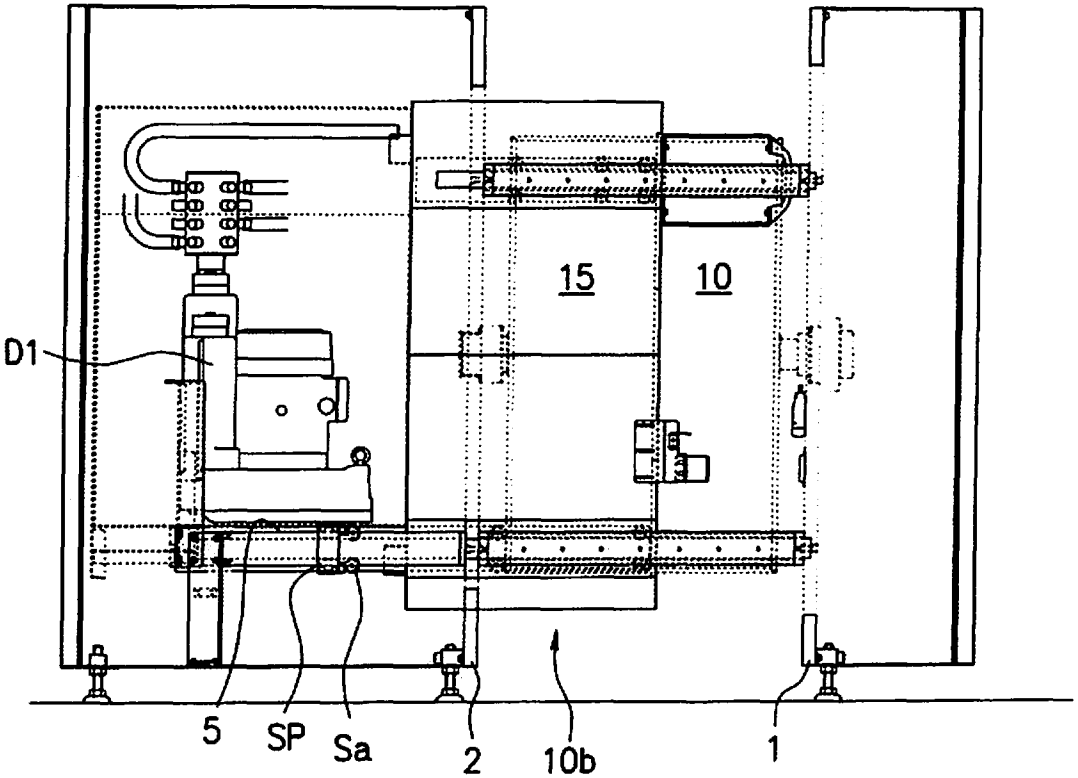
FIG. 7(A) is a perspective side view showing a state in which the chamber and the sliding parts are allowed to slide in the drying device of FIG. 4.
Figure 7B:
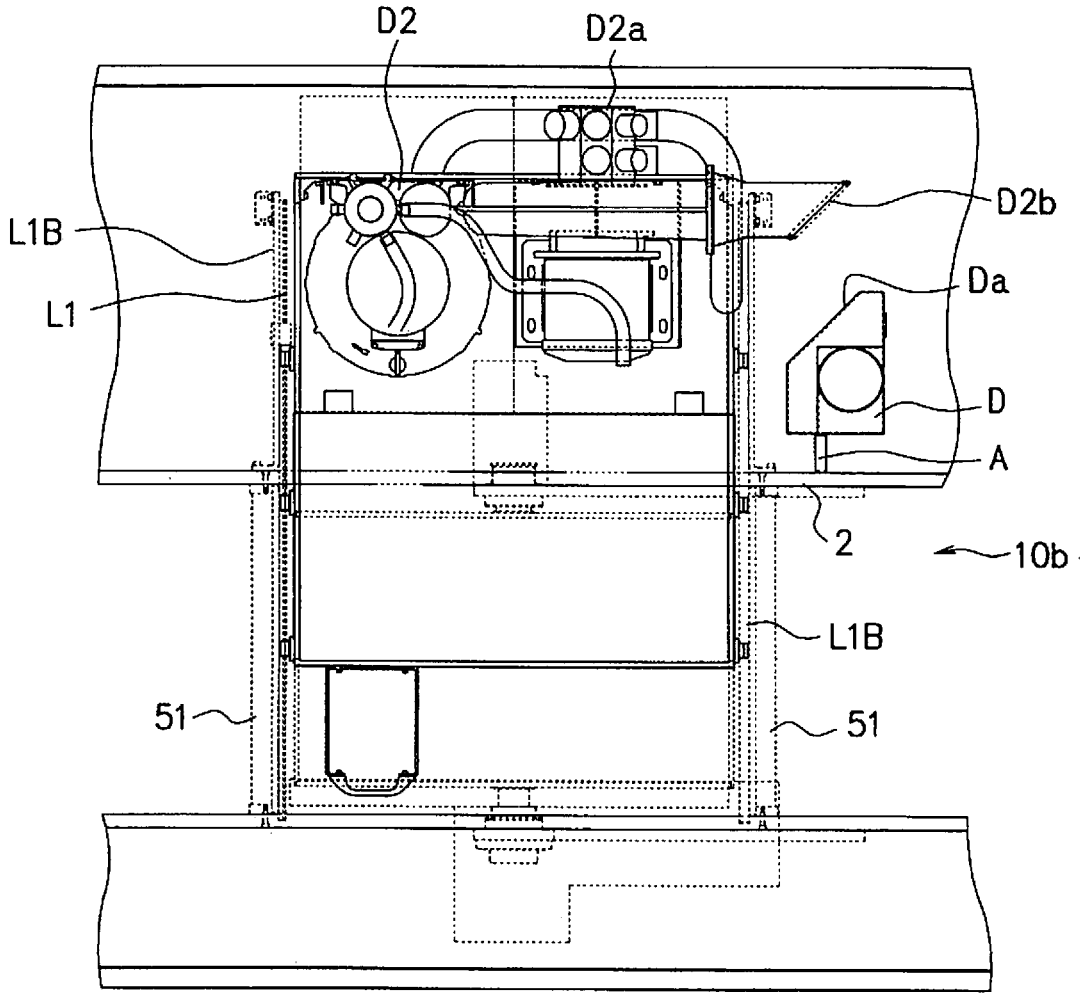
FIG. 7(B) is a perspective top view showing a state in which the chamber and the sliding parts are allowed to slide in the drying device of FIG. 5.

FIG. 7(A) is a perspective side view showing a state where the chamber and the sliding part of the drying device of FIG. 4 are allowed to slide, and FIG. 7(B) is a perspective top view showing a state where the chamber and the sliding part of the drying device of FIG. 5 are allowed to slide.

Additionally, in FIG. 7(A), illustrations of the cooling roller 40, the exhaust-use air blower D2, the exhaust duct D and the guide roller are omitted, and in FIG. 7(B), illustrations of the cooling roller 40 and the guide roller are omitted.

In the drying device H, the chamber 15 and the stage part 5 are made slidable along the rail parts La and La1 between a heating and drying position 10*a* at which the chamber 15 is located between the first plate frame 1 and the second plate frame 2 and a stand-by position 10*b* at which, as shown in FIG. 7(A) and FIG. 7(B), the chamber 15 is located outside on the side opposite to the first plate frame 1 of the second plate frame 2. For this reason, in the case when the chamber 15 and the stage part 5 are located at the heating and drying position 10*a*, the printed object X can be efficiently dried, and in the case when the chamber 15 and the stage part 5 are located at the stand-by position 10*b*, maintenance can be easily carried out safely. Moreover, when the chamber 15 and the stage part 5 are located at the stand-by position 10*b*, a feeding process of the printed object X to the drying device H and a repairing process or the like upon occurrence of a jam of the printed object X can be easily carried out.

In this case, in the drying device H, in the case when the chamber 15 and the stage part 5 are located at the heating and drying position 10*a*, air inside the chamber 15 is sent to the exhaust opening part D2*b* through the manifold D2*a* by the exhaust-use air blower D2, and is allowed to enter the introduction opening part Da of the exhaust duct D from the exhaust opening part D2*b*, and is then exhausted from the exhaust duct D (see FIG. 5). That is, the introduction opening part Da of the exhaust duct D and the exhaust opening part D2*b* of the exhaust-use air blower D2 are made in contact with each other so that the insides of these are communicated with each other.

At this time, onto the surface of the exhaust opening part D2*b* of the exhaust-use air blower D2, a soft packing is attached. On the other hand, the introduction opening part Da of the exhaust duct D has its contacting portion turned up or the like to form a surface. Therefore, when mutually made in contact with each other, the packing and the surface are made in contact so as to prevent air from leaking.

In the drying device H, in the case when the chamber 15 and the stage part 5 are not located at the heating and drying position 10*a*, the stage part 5 is allowed to slide, while the exhaust duct D is not allowed to slide, with the result that the introduction opening part Da of the exhaust duct D and the exhaust opening part D2*b* of the exhaust-use air blower D2 are separated from each other (see FIG. 7(B)). Additionally, in the case when the chamber 15 and the stage part 5 are not located at the heating and drying position 10*a*, since no heating and drying process of the printed object X is carried out, no air to be exhausted is generated.

At this time, the introduction opening part Da of the exhaust duct D and the exhaust opening part D2*b* of the exhaust-use air blower D2 only have their packing and surface separated from each other, as described above; therefore, the chamber 15 and the stage part 5 are made to slide without using any tool.

Returning again to FIG. 1(A) and FIG. 1(B), it can be seen that the printed object X that has been heated and dried by the heating roller part 10 and the hot air blowing part 11 housed in the chamber 15 is cooled by the cooling roller 40.

Figure 8:
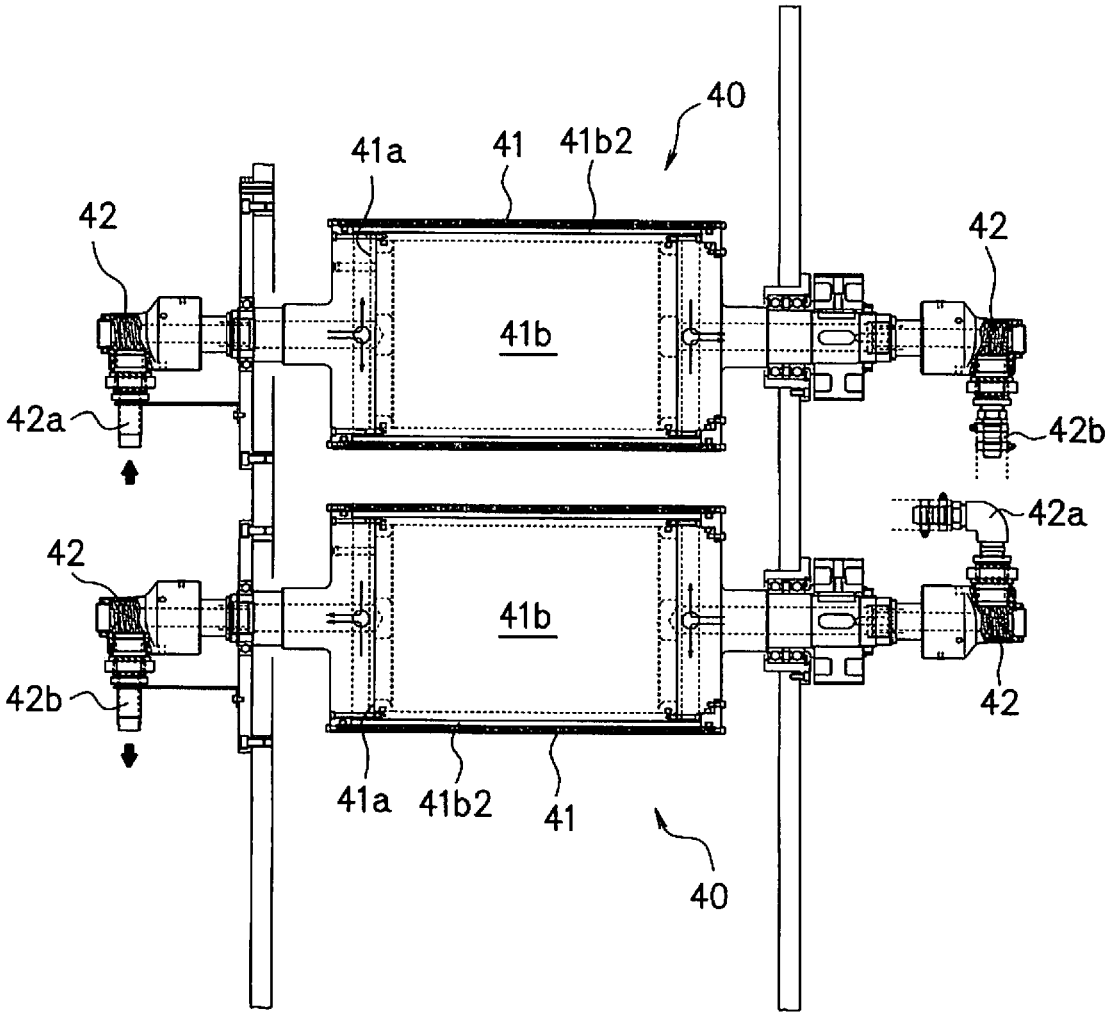
FIG. 8 is a vertical cross-sectional view cut in the width direction of a cooling roller of the drying device in accordance with the present embodiment.

FIG. 8 is a vertical cross-sectional view showing the cooling roller cut in its width direction of the drying device in accordance with the present embodiment.

As shown in FIG. 8, each cooling roller 40 is provided with a hollow column-shaped drum 41, a column part 41*b* built in a hollow part 41*a* of the drum 41, a rotary joint 42 attached to each of two ends of the drum 41 and an outgoing pipe 42*a* attached to the rotary joint 42 on one end side, as well as a return pipe 42*b* attached to the rotary joint 42 on the other end side.

In the cooling roller 40, the hollow part 41*a* of the drum 41, the rotary joints 42 on the two ends and the inside of the outgoing pipe 42*a* and the return pipe 42*b* are communicated with one another.

In the cooling roller 40, cooling water is allowed to flow into the drum 41 through the rotary joints 42.

More specifically, in the cooling roller 40, the cooling water is guided to an outside flow path 41*b*2 of the column part 41*b* of the hollow part 41*a* through the rotary joint 42 on one end side from the outgoing pipe 42*a*, and is allowed to flow out from the outside flow path 41*b* into the return pipe 42*b* through the rotary joint 42 on the other end side. Thus, the cooling roller 40 can be sufficiently cooled.

Next, explanation is given to an ink-jet printing device in accordance with the present invention.

Figure 9:
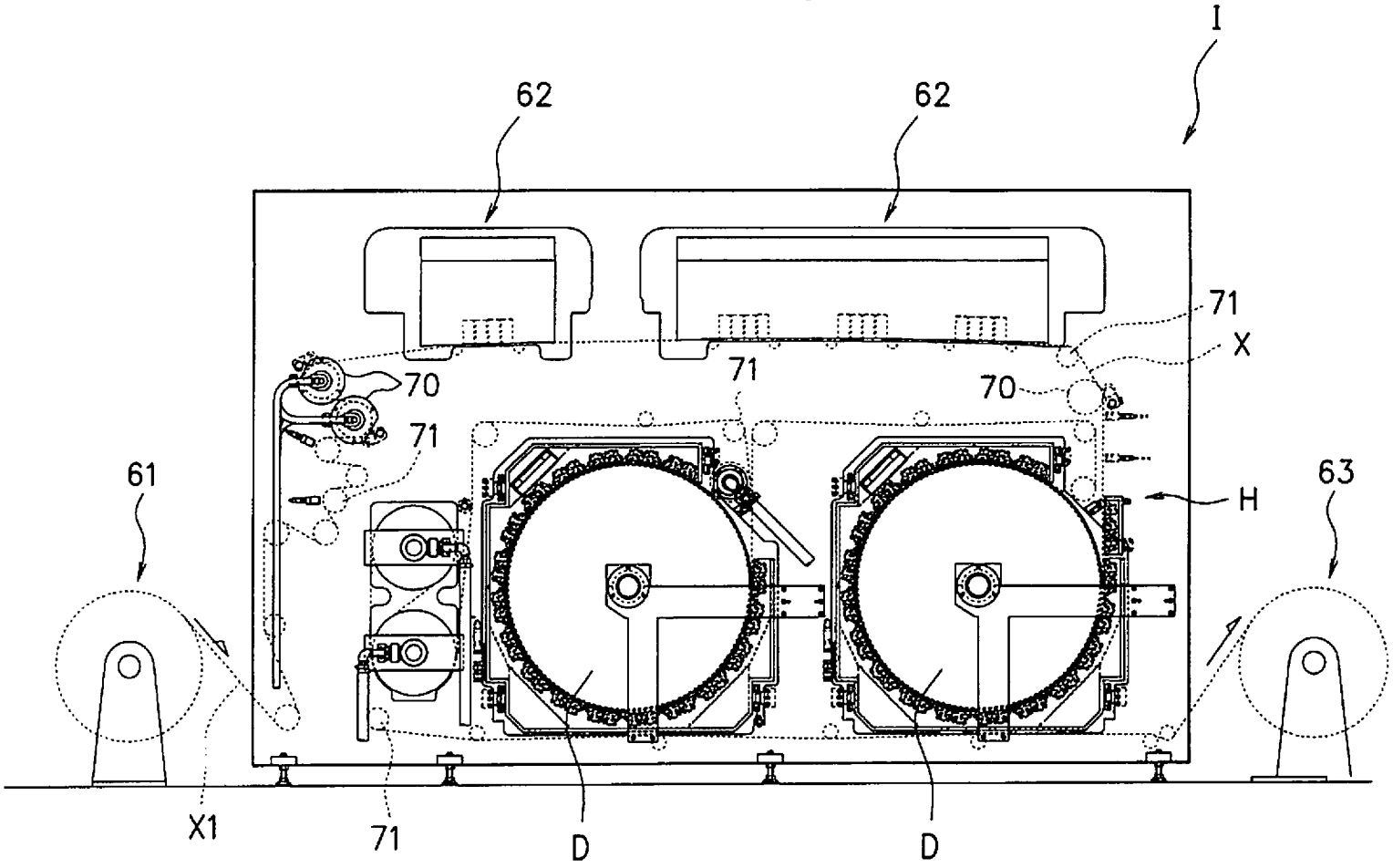
FIG. 9 is a perspective side view schematically showing one embodiment of an ink-jet printing device in accordance with the present invention.

FIG. 9 is a perspective side view schematically showing an embodiment of the ink-jet printing device in accordance with the present invention.

As shown in FIG. 9, an ink-jet printing device I in accordance with the present embodiment is provided with a paper feeding part 61 for supplying a printing object X1, a printing part 62 for printing the printing object X1 while transporting it and a drying device H for drying a long-sized printed object X that has been printed by the printing part 62 while transporting it and a collecting part 63 for collecting the dried printed object X.

In the ink-jet printing device I, the drying devices H are installed in parallel with each other on the upstream side and the downstream side.

In the ink-jet printing device I, the printing part 62 is constituted by a plurality of ink-jet printing heads. Additionally, as the system of the ink-jet printing heads, a line head system or a serial head system may be used.

Moreover, into each of the ink-jet printing heads, the aforementioned ink is filled for each of the colors of YMCK, or the like.

In the ink-jet printing device I, the printed object X is transported at a desired speed by rotating a pull roller 70 by a servo motor, not shown.

Moreover, the tension of the printed object X is detected by a tension roller 71 to which a tension sensor, not shown, using a load cell or the like is attached so that the rotation amount of the pull roller 70 can be adjusted by the servo motor so as to achieve a target tension.

Furthermore, the transporting path of the printed object X below the printing part 62 has an arch shape. Thus, it becomes possible to suppress flapping of the printed object X.

In the ink-jet printing device I, since the above-mentioned drying device H is installed, the printed object X that has been subjected to printing processes by the plural ink-jet printing heads can be heated and dried efficiently and maintenance of the drying device H can be easily carried out safely.

Moreover, by installing the drying devices H in parallel with each other on the upstream side and the downstream side, the drying time relative to the printed object X to be transported can be made sufficiently longer. In this case, since the printed object X can be dried even at a comparatively low temperature, it becomes possible to suppress the printed object X itself from being curled due to heat, or wrinkles and cockling from occurring in the printed object X.

On the other hand, even in the case when the drying devices H are installed in parallel with each other, since they are made to be independently slidable in the width direction of the printed object, they are prevented from intervening with each other at the time of maintenance.

Although embodiments of the present invention have been explained above, the present invention is not intended to be limited by the above-mentioned embodiments.

A plurality of the drying devices H relating to the present embodiment may be installed side by side and used.

Figure 10:
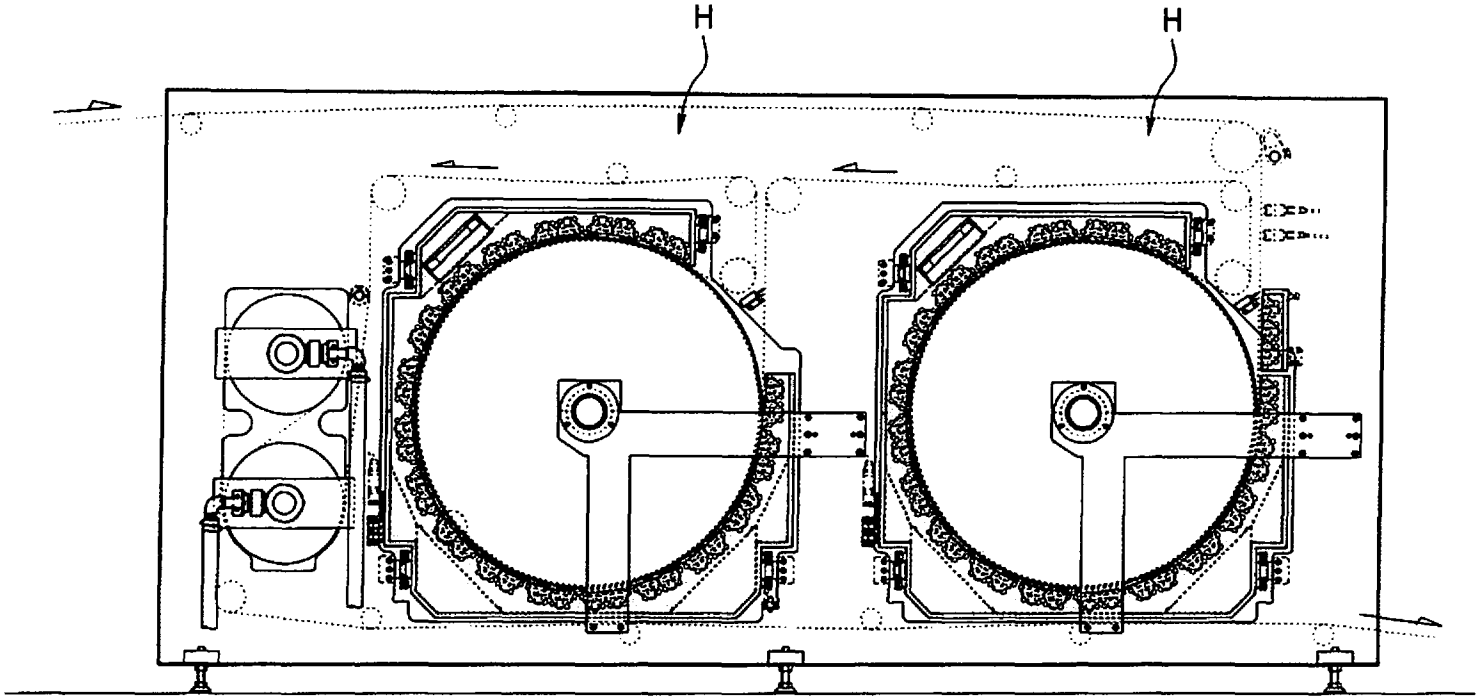
FIG. 10 is a perspective side view showing an example in which the drying devices relating to the present invention are installed side by side.

FIG. 10 is a perspective side view showing a state in which the drying devices H relating to the present invention are installed side by side.

As shown in FIG. 10, by using the drying devices H installed side by side, the drying time relative to the printed object to be transported can be made sufficiently longer.

Moreover, by making the setting temperature of the heating roller part 10 on the downstream side higher than the setting temperature of the heating roller part 10 on the upstream side, the wet printed object X is sufficiently heated by the heating roller part 10 and the hot air blowing part 11 that are on the upstream side and have the comparatively low setting temperature, and a sufficient evaporation energy can be applied to the aqueous solvent by the heating roller part 10 and the hot air blowing part 11 that are on the downstream side and have the comparatively high setting temperature. That is, since the wet printed object X immediately after the printing process can be heated step by step, the printed object X can be positively heated and it also becomes possible to suppress curling of the printed object X itself or wrinkles and cockling from occurring in the printed object X.

In the drying device H in accordance with the present embodiment, the heating roller part 10 is provided with the hollow column-shaped drum 12, the band heater 13 for heating the drum 12 and the shaft core 16 to which the two sides of the drum 12 are attached and fixed; however, the heating roller part 10 is not limited by this structure, as long as the outer circumferential surface of the heating roller part 10 can be heated.

In the drying device H in accordance with the present embodiment, the drum 12 of the heating roller part 10 has its outer circumferential surface subjected to irregularity machining; however, this process is not necessarily required.

Moreover, instead of the irregularity machining, thin grooves may be formed on the surface of the drum 12.

In the drying device H in accordance with the present embodiment, as the hot air blowing part 11, the hot air blowing devices 14 that are arranged side by side are exemplified; however, the present invention is not intended to be limited by this structure, as long as at least one surface of the printed object X can be heated and dried.

In the drying device H in accordance with the present embodiment, the plate shaped first plate frame 1 and second Plate frame 2 are provided; however, a box member including these frames as an integral unit may be used.

In the drying device H in accordance with the present embodiment, the chamber 15 is temporarily fixed to the heating and drying position 10*a* by mutual magnetic adhesion between the magnet parts G; however, the temporarily fixing method is not limited by this method.

Moreover, the installation of the limit switch RS is not necessarily indispensable.

In the drying device H in accordance with the present embodiment, the first door part 1*a* is installed on the first plate frame 1 and the second door part 2*a* is installed on the second plate frame 2; however, the first door part 1*a* and the second door part 2*a* are not necessarily indispensable.

In the drying device H in accordance with the present embodiment, by making the sliding part Sa in contact with the stopper SP, the chamber 15 is made to stop at the stand-by position 10*b*; however, by making the stopper part SP in contact with another portion, the chamber 15 may be made to stop at the stand-by position 10*b*.

In the drying device H in accordance with the present embodiment, the structures of the rail part and the sliding part are not particularly limited as long as the chamber 15 and the stage part 5 are made slidable.

In the drying device H in accordance with the present embodiment, the cooling roller 40 is provided with the hollow column-shaped drum 41, the column part 41*b* built in the hollow part 41*a* of the drum 41, the rotary joints 42 respectively attached to the two ends of the drum 41, the outgoing pipe 42*a* attached to the rotary joint 42 on one end side and the return pipe 42*b* attached to the rotary joint 42 on the other end; however, the present invention is not limited by this structure, as long as the printed object X can be cooled.

INDUSTRIAL APPLICABILITY

The drying device of the present invention can be utilized as a device in which while transporting a long-sized printed object formed by applying an ink onto a printing object to be printed by a printing part of a printing device, the printed object is dried. In accordance with the drying device, the printed object can be efficiently heated and dried, and maintenance can be easily carried out safely.

The ink-jet printing device of the present invention can be utilized as a device in which by applying an ink to a printing object, characters and patterns can be printed thereon. In accordance with the ink-jet printing device, since the printing device is provided with the above-mentioned drying device, the printed object can be heated and dried efficiently, and the maintenance of the drying device can be easily carried out safely.

REFERENCE SIGNS LIST

1 . . . first plate frame,
1*a* . . . first door part,
2 . . . second plate frame,
2*a* . . . second door part,
10 . . . heating roller part,
10*a* . . . heating and drying position,
10*b* . . . stand-by position,
11 . . . hot air blowing part,
12, 41 . . . drum,
13 . . . band heater,
13*a* . . . power source terminal,
13*b* . . . thermocouple,
13*c* . . . thermostat,
14 . . . hot air blowing device,
14*a* . . . blowing unit,
14*a*1 . . . sheath heater,
14*a*2 . . . nozzle pipe,
14*a*3 . . . heater cover,
14*a*4 . . . bottom plate,
15 . . . chamber,
15*a* . . . exhaust opening,
16 . . . shaft core,
16*a* . . . power source-use rotary connector,
16*b* . . . signal-use rotary connector,
40 . . . cooling roller,
41*a* . . . hollow part,
41*b* . . . column part,
41*b*2 . . . outside flow path,
42 . . . rotary joint,
42*a* . . . outgoing pipe,
42*b* . . . return pipe,
5 . . . stage part,
51 . . . stay,
51*a* . . . leg part,
52*a* . . . rail base,
52*b* . . . auxiliary rail base,
53*a* . . . plate,
53*b* . . . auxiliary plate,
55 . . . covering member,
61 . . . paper feeding part,
62 . . . printing part,
63 . . . collecting part,
70 . . . pull roller,
71 . . . tension roller,
A . . . arm part,
B1, B2 . . . bracket,
D . . . exhaust duct,
Da . . . introduction opening part,
D1 . . . supply-use air blower,
D2 . . . exhaust-use air blower,
D2*a* . . . manifold,
D2*b* . . . exhaust opening part,
G . . . magnet part,
H . . . drying device,
H1 . . . shortest distance,
H2 . . . width,
I . . . ink-jet printing device,
J1, J2 . . . coupling member,
K . . . cut-out part,
La, La1 . . . rail part,
Lb, Lb1 . . . auxiliary rail part,
M1 . . . convex part,
M2 . . . concave part,
N . . . nozzle hole,
R . . . rib part,
RS . . . limit switch,
S . . . slit,
Sa . . . sliding part,
Sb . . . auxiliary sliding part,
SP . . . stopper,
T . . . gap,
X . . . printed object,
X1 . . . printing object

The invention claimed is:

1. A drying device wherein, while transporting a long-sized printed object to which an ink has been applied by a printing part, the printed object is dried, comprising:

a heating roller part capable of guiding the printed object and heating a rear surface of the printed object;

a hot air blowing part that is formed so as to be opposed to an outer circumferential surface of the heating roller part, and used for blowing hot air to a printing surface of the printed object;

a chamber in which the heating roller part and the hot air blowing part are housed;

a first plate frame and a second plate frame installed on two sides of the chamber so as to sandwich the chamber;

a supply-use air blower for supplying air to the hot air blowing part through a supply opening formed on the chamber;

an exhaust-use air blower for exhausting air inside the chamber through an exhaust opening formed on the chamber; and a stage part on which the supply-use air blower and the exhaust-use air blower are mounted, wherein the hot air blowing part is attached and fixed to the chamber, a cut-out part through which the chamber is allowed to pass is formed on the second plate frame, and the chamber and the stage part are installed side by side in a width direction of the printed object, and coupled to each other through the cut-out part into an integral unit, and wherein a pair of rail parts extending in the width direction of the printed object are formed on the first plate frame and second plate frame so as to cross-link the first plate frame and second plate frame and also to pass through the cut-out part, and the chamber and the stage part are allowed to slide along the rail parts between a heating and drying position at which the chamber is located between the first plate frame and the second plate frame, and a stand-by position at which the chamber is located at a position where at least one portion of the heating roller part is exposed.

2. The drying device according to claim 1, wherein the exhaust-use air blower is provided with a manifold, and a plurality of the exhaust openings are formed on the chamber, and wherein air is sent to the manifold from the respective exhaust openings through pipes so that the air thus collected is sent from the manifold to an exhaust duct.

3. The drying device according to claim 1, wherein a pair of plates that extend in a width direction of the printed object are attached to the chamber, and a sliding part capable of sliding on the rail part is attached to each of the plates.

4. The drying device according to claim 1, wherein an auxiliary rail part extending in the width direction of the printed object is formed on the first plate frame and second plate frame so as to cross-link the first plate frame and second plate frame, an auxiliary plate extending in the width direction of the printed object is attached to the chamber, and an auxiliary sliding part capable of sliding on the auxiliary rail part is attached to the auxiliary plate, and wherein the auxiliary rail part is installed above the rail part, with the auxiliary rail part being made shorter than the rail part.

5. The drying device according to claim 1, further comprising: a covering member for covering the supply-use air blower and the exhaust-use air blower, wherein the covering member is freely detachably attached to the stage part.

6. The drying device according to claim 1, wherein to the second plate frame, an exhaust duct is coupled and fixed through an arm part, and in the case when the chamber and the stage part are located at the heating and drying position, an introduction opening part of the exhaust duct and an exhaust opening part of the exhaust-use air blower are made in contact with each other so that the insides thereof are communicated with each other, while in the case when the chamber and the stage part are not located at the heating and drying position, the introduction opening part and the exhaust opening part are separated from each other.

7. An ink-jet printing device comprising: a printing part which, while transporting a printing object, carries out a printing process on the printing object, and a drying device according to claim 1 which, while transporting a long-sized printed object that was printed by the printing part, dries the printed object, wherein the printing part is constituted by a plurality of ink-jet printing heads.

8. The ink-jet printing device according to claim 7, wherein the drying devices are installed in parallel with each other on the upstream side and the downstream side.

* * * * *